US011813849B2

(12) United States Patent
Hirabayashi

(10) Patent No.: US 11,813,849 B2
(45) Date of Patent: Nov. 14, 2023

(54) TAPE PRINTING APPARATUS, INFORMATION PROCESSING APPARATUS, METHOD FOR CONTROLLING TAPE PRINTING APPARATUS, AND STORAGE MEDIUM

(71) Applicant: SEIKO EPSON CORPORATION, Tokyo (JP)

(72) Inventor: Naofumi Hirabayashi, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 282 days.

(21) Appl. No.: 17/215,142

(22) Filed: Mar. 29, 2021

(65) Prior Publication Data

US 2021/0300068 A1 Sep. 30, 2021

(30) Foreign Application Priority Data

Mar. 30, 2020 (JP) ..... 2020-059829

(51) Int. Cl.
*B41J 11/00* (2006.01)
*B41J 3/407* (2006.01)

(52) U.S. Cl.
CPC ..... *B41J 11/009* (2013.01); *B41J 3/4075* (2013.01)

(58) Field of Classification Search
CPC . B41J 15/00; B41J 15/04; B41J 15/044; B41J 15/046; B41J 13/00; B41J 13/0009; B41J 3/4075; B41J 11/009; B41J 3/46
See application file for complete search history.

(56) References Cited

U.S. PATENT DOCUMENTS 5,680,520 A * 10/1997 Watanabe ..... B41J 3/4075 358/1.11
2002/0178189 A1 11/2002 Kurashina
2008/0292381 A1* 11/2008 Tanjima ..... B41J 3/4075 400/76
2012/0268756 A1 10/2012 Kurashina
2018/0253271 A1 9/2018 Oida

FOREIGN PATENT DOCUMENTS

JP 2002-318796 A 10/2002
JP 2012-224053 A 11/2012
JP 2014-188728 A 10/2014
JP 2017-052249 A 3/2017

* cited by examiner

*Primary Examiner* — Kristal Feggins
(74) *Attorney, Agent, or Firm* — Oliff PLC

(57) ABSTRACT

A tape printing apparatus includes: a storage control unit that causes a storage unit to store a text file that contains a text in association with information that indicates a type of a printing tape; a detection unit that detects the type of the printing tape that is a target of printing; an extraction unit that extracts, out of the storage unit, the text file associated with the information that indicates the type of the printing tape detected by the detection unit; and a display control unit that causes a display unit to display the extracted text file as a selection candidate for the text file that is to be printed on the printing tape.

7 Claims, 17 Drawing Sheets

FIG. 10

| TEXT FILE | TAPE INFORMATION | |
|---|---|---|
| | TAPE TYPE INFORMATION | TAPE WIDTH INFORMATION |
| 5555 | DIE CUT TAPE | 24 mm |
| 11111111 | CONTINUOUS TAPE | 12 mm |
| 222222222222 | CONTINUOUS TAPE | 12 mm |
| ABCD | DIE CUT TAPE | 24 mm |
| ABCDEFGH IJKLMNOP | CONTINUOUS TAPE | 24 mm |
| 333 | DIE CUT TAPE | 24 mm |

TAPE PRINTING APPARATUS, INFORMATION PROCESSING APPARATUS, METHOD FOR CONTROLLING TAPE PRINTING APPARATUS, AND STORAGE MEDIUM

The present application is based on, and claims priority from JP Application Serial Number 2020-059829, filed Mar. 30, 2020, the disclosure of which is hereby incorporated by reference herein in its entirety.

BACKGROUND

1. Technical Field

Embodiments of the present disclosure relate to a tape printing apparatus, an information processing apparatus, a method for controlling a tape printing apparatus, and a storage medium.

2. Related Art

JP-A-2012-224053 discloses a label data processing apparatus that includes: a storage unit that stores label data containing a text; and a display unit that switches and displays, per label data, an edit screen that includes at least a part of the text included in the label data, as a selection candidate for the label data. The label data processing apparatus disclosed in JP-A-2012-224053 is able to selectively use one of plural types of printing tape.

In the technique disclosed in JP-A-2012-224053, the same selection candidates are displayed on the display unit as selection candidates for label data to be printed on a printing tape, irrespective of the type of the printing tape that is the target of printing. Therefore, if the user selects label data that cannot be printed on the printing tape by mistake, an error will be displayed either when the label data is selected or when the printing of the label data is instructed. This is not friendly to the user.

SUMMARY

A tape printing apparatus according to a certain aspect of the present disclosure includes: a printing unit that performs printing on a printing tape; a storage control unit that causes a storage unit to store a text file that contains a text in association with information that indicates a type of the printing tape; a detection unit that detects the type of the printing tape that is a target of printing; an extraction unit that extracts, out of the storage unit, the text file associated with the information that indicates the type of the printing tape detected by the detection unit; and a display control unit that causes a display unit to display the extracted text file as a selection candidate for the text file that is to be printed on the printing tape.

Another aspect of the present disclosure is a method for controlling a tape printing apparatus that performs printing on a printing tape, including: causing a storage unit to store a text file that contains a text in association with information that indicates a type of the printing tape; detecting the type of the printing tape that is a target of printing; extracting, out of the storage unit, the text file associated with the information that indicates the detected type of the printing tape; and causing a display unit to display the extracted text file as a selection candidate for the text file that is to be printed on the printing tape.

Another aspect of the present disclosure is an information processing apparatus configured to communicate with a tape printing apparatus that performs printing on a printing tape, the information processing apparatus including: a storage control unit that causes a storage unit to store a text file that contains a text in association with information that indicates a type of the printing tape; a receiving unit that receives information that indicates the type of the printing tape that is a target of printing from the tape printing apparatus; an extraction unit that extracts, out of the storage unit, the text file associated with the received information that indicates the type of the printing tape; and a display control unit that causes a display unit to display the extracted text file as a selection candidate for the text file that is to be printed on the printing tape.

Another aspect of the present disclosure is a non-transitory storage medium storing a program for causing an information processing apparatus configured to communicate with a tape printing apparatus that performs printing on a printing tape to execute operations including: causing a storage unit to store a text file that contains a text in association with information that indicates a type of the printing tape; receiving information that indicates the type of the printing tape that is a target of printing from the tape printing apparatus; extracting, out of the storage unit, the text file associated with the received information that indicates the type of the printing tape; and causing a display unit to display the extracted text file as a selection candidate for the text file that is to be printed on the printing tape.

BRIEF DESCRIPTION OF THE DRAWINGS

FIG. 10 is a diagram that illustrates an example of file data.

DESCRIPTION OF EXEMPLARY EMBODIMENTS

With reference to the accompanying drawings, a tape printing apparatus, an information processing apparatus, a method for controlling a tape printing apparatus, and a non-transitory storage medium storing a program according to some exemplary embodiments of the present disclosure will now be explained. An XYZ orthogonal coordinate system is illustrated in FIGS. 1 to 6. However, the coordinate system is shown merely for the purpose of facilitating the reader's understanding and therefore shall not be construed to limit the embodiments described below.

Overview of Tape Printing Apparatus, Tape Cartridge, and Ribbon Cartridge

Figure 1:
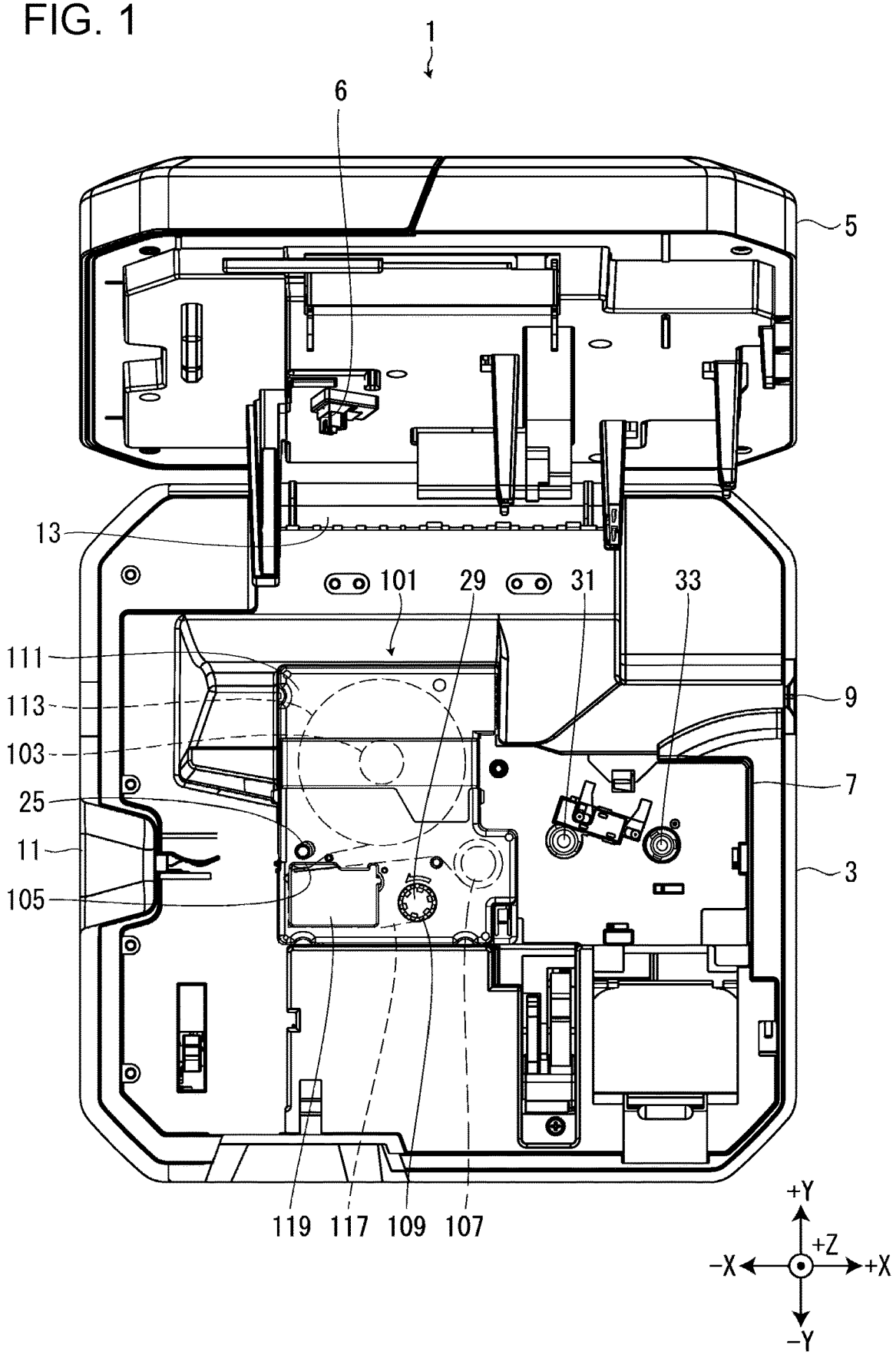
FIG. 1 illustrates a tape printing apparatus with a tape cartridge attached to its cartridge attachment portion, as viewed from the front side in the attachment direction.
Figure 2:
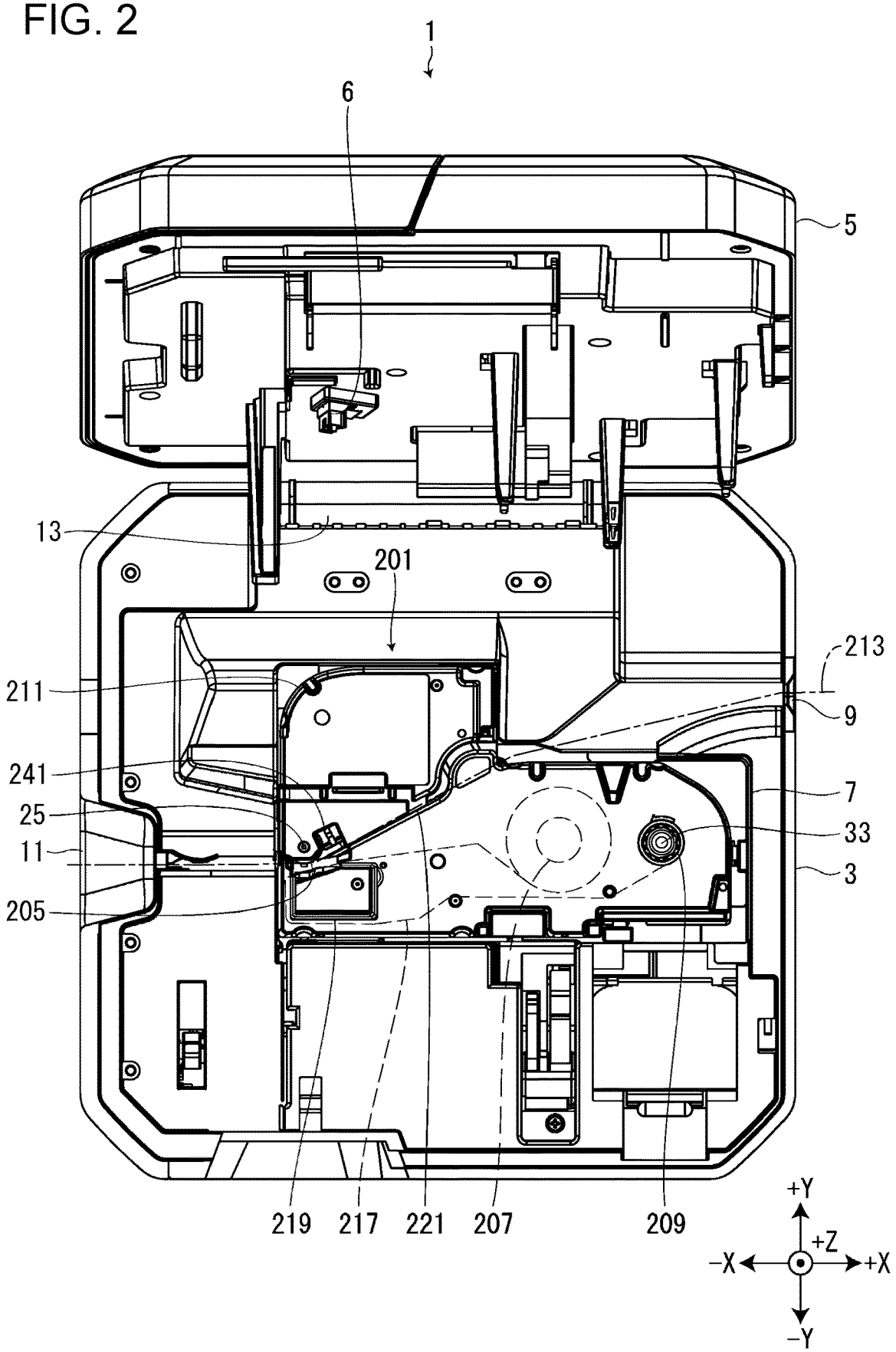
FIG. 2 illustrates a tape printing apparatus with a ribbon cartridge attached to its cartridge attachment portion, as viewed from the front side in the attachment direction.

As illustrated in FIGS. 1 and 2, a tape printing apparatus 1 includes an apparatus case 3 and an attachment portion cover 5. The apparatus case 3 has a shape of a substantially rectangular parallelepiped. A cartridge attachment portion 7 is provided at a +Z-direction of the apparatus case 3. Either a tape cartridge 101 illustrated in FIG. 1 or a ribbon cartridge 201 illustrated in FIG. 2 is selectively attached to the cartridge attachment portion 7.

Figure 8:
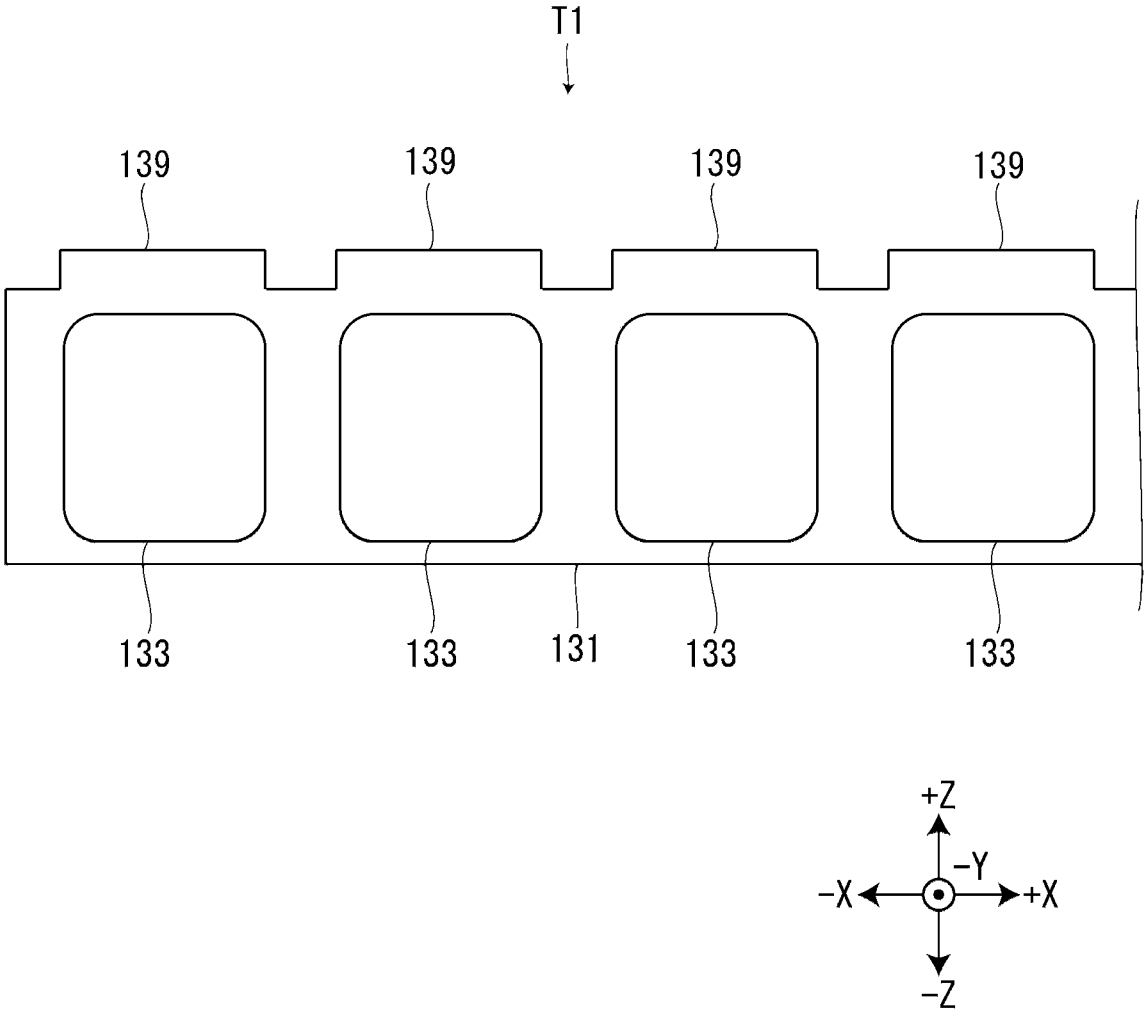
FIG. 8 is a diagram that illustrates a die cut tape.

In the +X-directional face of the apparatus case 3, a tape entrance 9 is provided. A second printing tape 213 reeled out from a tape roll provided outside the tape printing apparatus 1 is fed in through the tape entrance 9 when the ribbon cartridge 201 is attached to the cartridge attachment portion 7. A tape exit 11 is provided in the −X-directional face of the apparatus case 3. A first printing tape 113 reeled out from the tape cartridge 101 attached to the cartridge attachment portion 7, or the second printing tape 213 fed in through the tape entrance 9, goes out through the tape exit 11. The attachment portion cover 5 can be opened and closed for uncovering and covering the cartridge attachment portion 7. The attachment portion cover 5 is mounted on the apparatus case 3 in such a way as to be able to rotate around a first hinge portion 13 provided on the +Y-directional end portion. A sensor 6 is provided on the inner surface of the attachment portion cover 5. The sensor 6 is used for detecting the position of a medium label 133 if the second printing tape 213 fed in through the tape entrance 9 is a die cut tape T1, which will be described later, as illustrated in FIG. 8.

Figure 3:
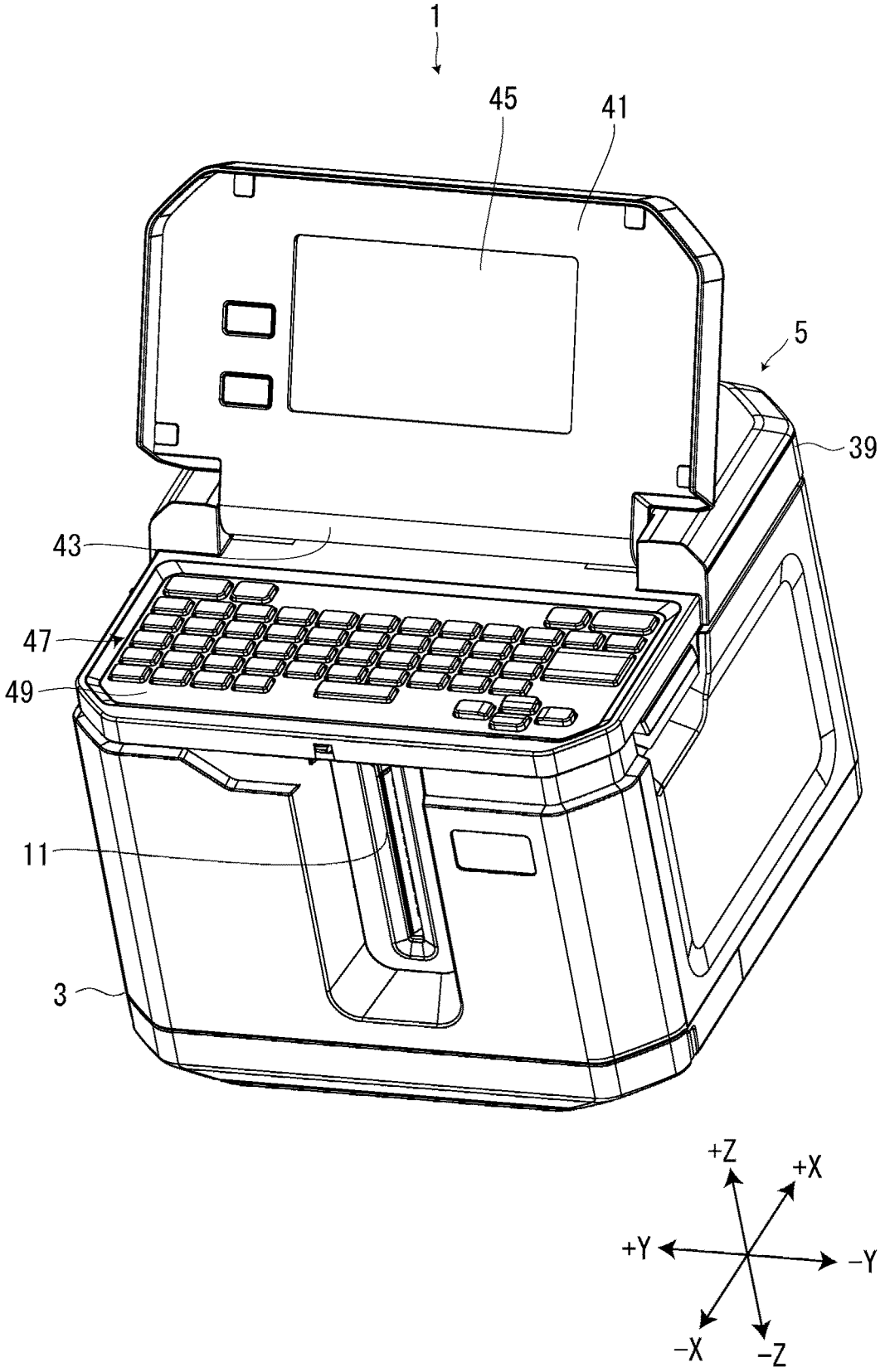
FIG. 3 is a perspective view of a tape printing apparatus, with its attachment portion cover closed and its keyboard cover opened.

As illustrated in FIG. 3, the attachment portion cover 5 includes a cover body 39 and a keyboard cover 41. A keyboard mount portion 49 is provided at a roughly half −X-directional area of the cover body 39. A keyboard 47 is mounted on the keyboard mount portion 49. Plural keys such as character keys, numeric keys, and the like are arranged on the keyboard 47. The keyboard cover 41 is mounted on the cover body 39 in such a way as to be able to rotate around a second hinge portion 43 provided on its +X-directional end portion. A touch panel 45 is provided on the inner surface of the keyboard cover 41. A user performs various kinds of operation using the touch panel 45 and the keyboard 47.

Figure 5:
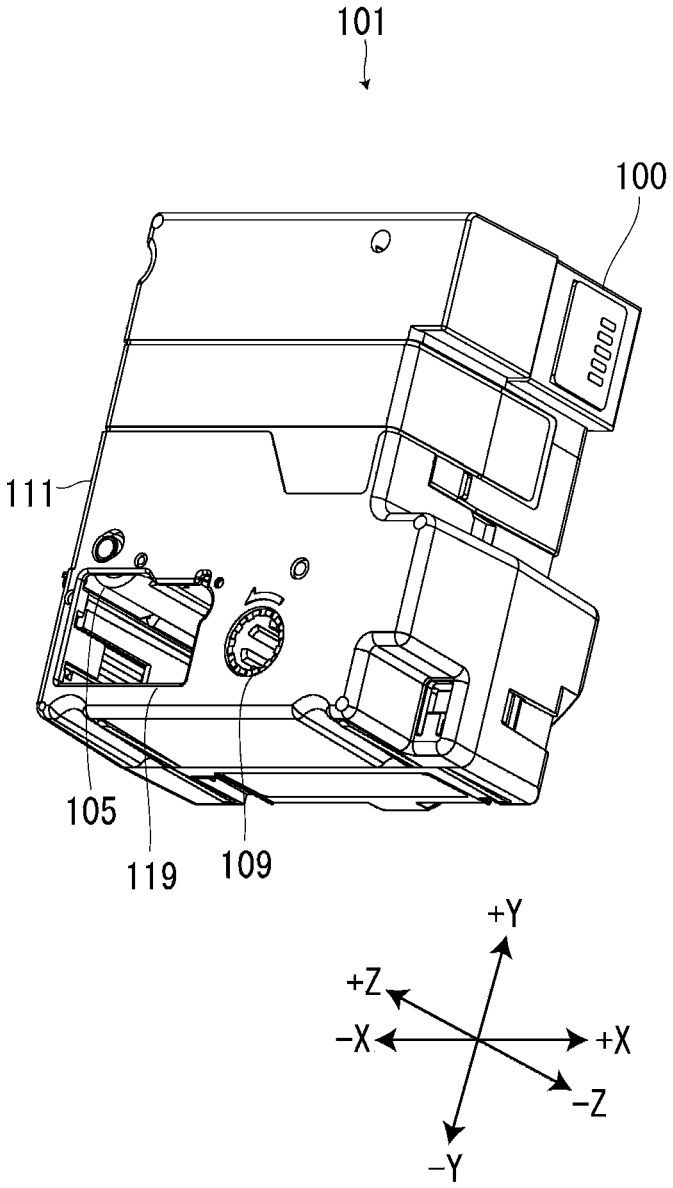
FIG. 5 is a perspective view of the tape cartridge.

As illustrated in FIGS. 1 and 5, the tape cartridge 101 includes a tape core 103, a first platen roller 105, a first unreeling core 107, a first reeling core 109, and a first cartridge case 111 inside which these cores and roller are housed. The first printing tape 113 is wound around the tape core 103. The first printing tape 113 reeled out from the tape core 103 is fed to go out of the first cartridge case 111 through a non-illustrated tape outlet provided in the −X-directional sidewall of the first cartridge case 111. A first ink ribbon 117 is wound around the first unreeling core 107. The first ink ribbon 117 reeled out from the first unreeling core 107 is reeled onto the first reeling core 109. A first head insertion hole 119 is provided as an opening going through the first cartridge case 111 in the Z direction.

Figure 4:
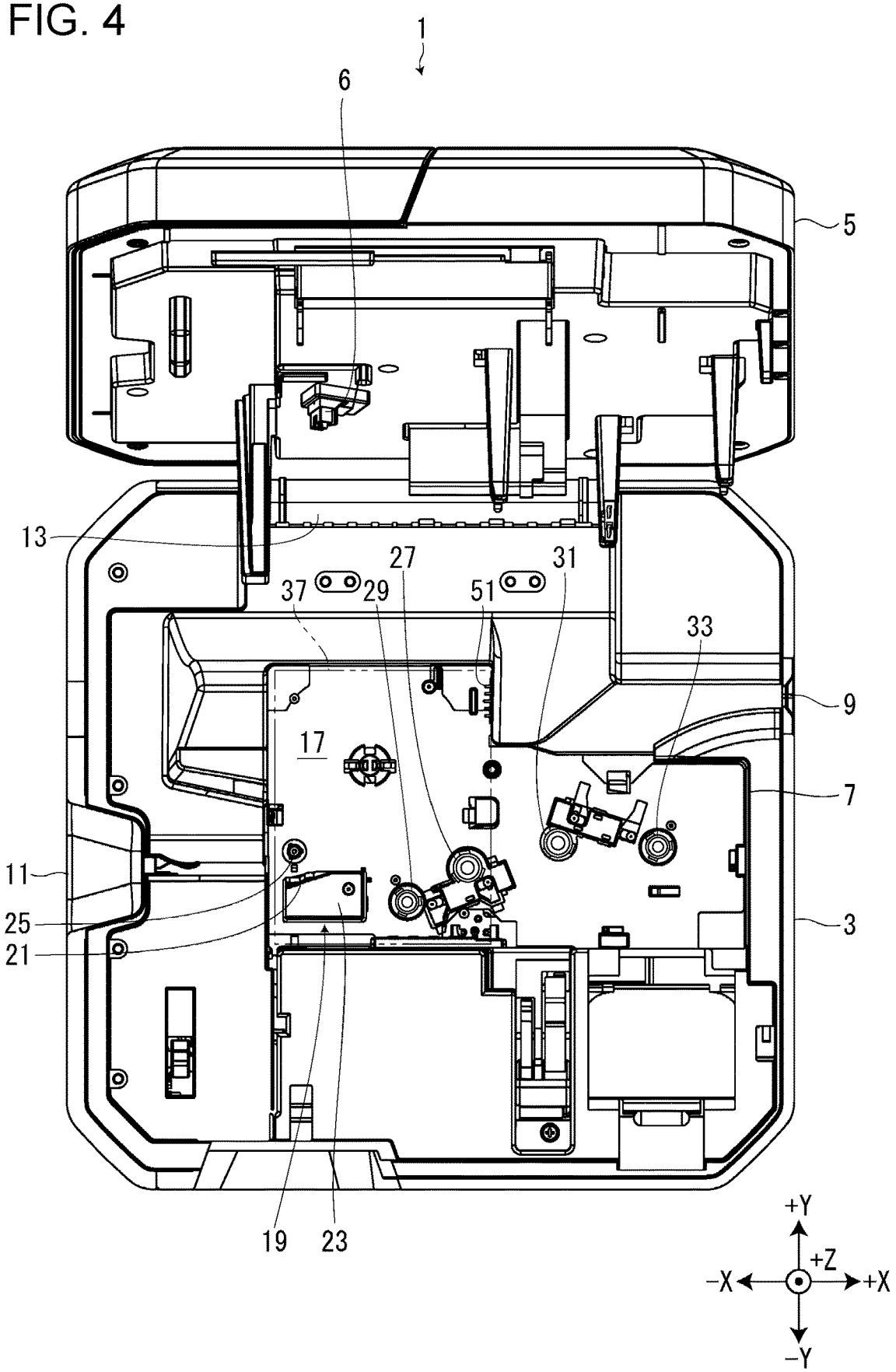
FIG. 4 illustrates a tape printing apparatus with neither a tape cartridge nor a ribbon cartridge attached to its cartridge attachment portion, as viewed from the front side in the attachment direction.

As illustrated in FIG. 5, a first circuit board 100 is provided on a +Y-side +X-directional outer surface of the first cartridge case 111. Cartridge information described later is stored in the first circuit board 100. The first circuit board 100 is configured to be connected to a circuit board connection portion 51 provided on the cartridge attachment portion 7 as illustrated in FIG. 4.

Figure 6:
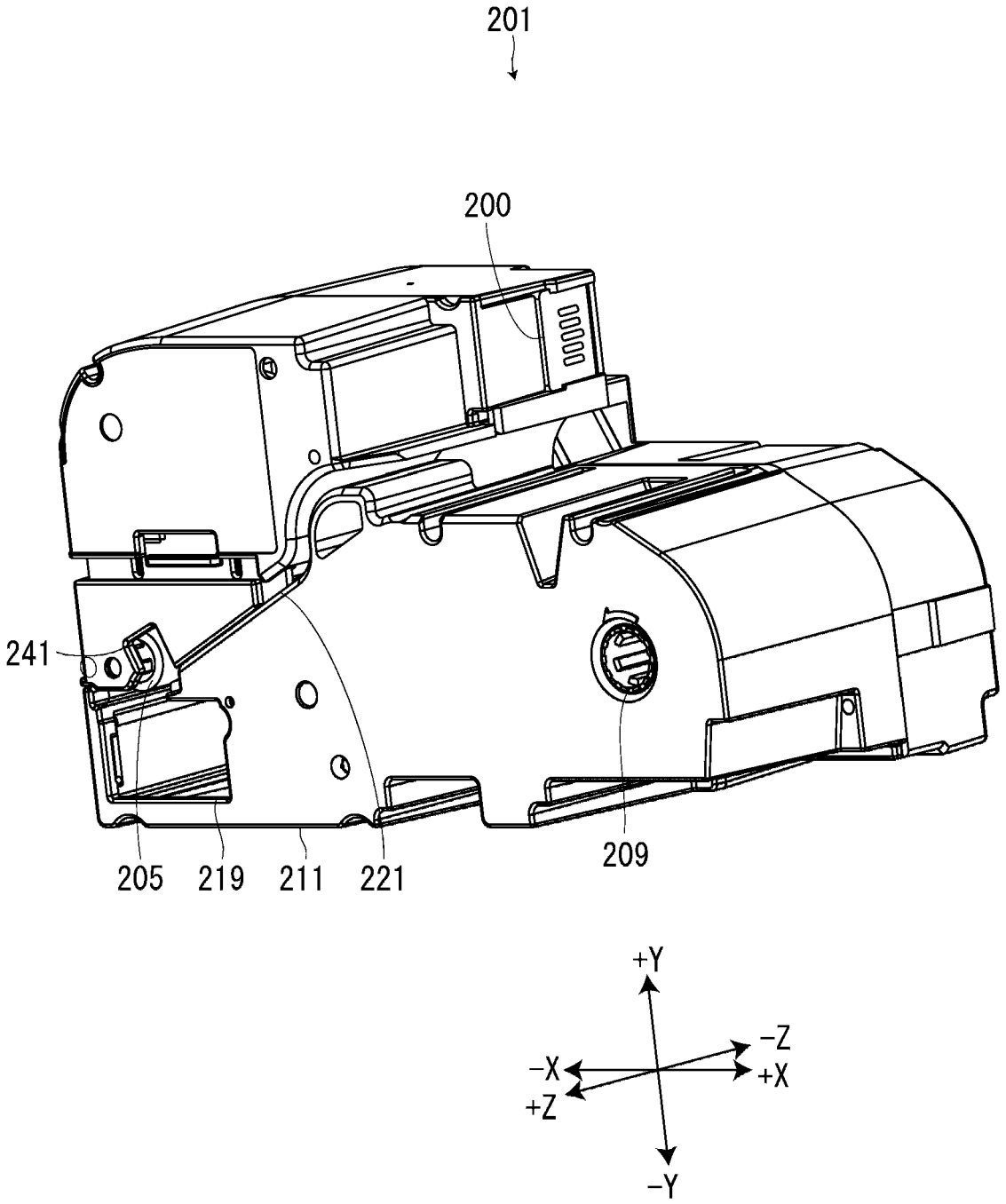
FIG. 6 is a perspective view of the ribbon cartridge.

As illustrated in FIGS. 2 and 6, the ribbon cartridge 201 includes a second platen roller 205, a second unreeling core 207, a second reeling core 209, and a second cartridge case 211 inside which these cores and roller are housed. A second ink ribbon 217 is wound around the second unreeling core 207. The second ink ribbon 217 reeled out from the second unreeling core 207 is reeled onto the second reeling core 209. A second head insertion hole 219 is provided as an opening going through the second cartridge case 211 in the Z axis. A second tape path 221 is provided inside the second cartridge case 211. The second printing tape 213 fed in through the tape entrance 9 travels along the second tape path 221 to go to the tape exit 11.

As illustrated in FIG. 6, a second circuit board 200 is provided on the outer surface of the second cartridge case 211 at a position for contact with the circuit board connection portion 51 of the cartridge attachment portion 7. Cartridge information is stored in the second circuit board 200, similarly to the first circuit board 100. An exposure area 241 is provided in the +Z-directional surface of the second cartridge case 211. If the second printing tape 213 is a die cut tape T1 as illustrated in FIG. 8, a detection tab 139 of the die cut tape T1 is exposed at the exposure area 241.

The length of the second printing tape 213 on a new tape roll that has never been used and the length of the second ink ribbon 217 housed in a new ribbon cartridge 201 that has never been used are not specifically limited. However, in the present embodiment, these lengths are greater than the length of the first printing tape 113 housed in a new tape cartridge 101 that has never been used and the length of the first ink ribbon 117 housed in the new tape cartridge 101 that has never been used respectively. Therefore, for example, the ribbon cartridge 201 is attached to the cartridge attachment portion 7 when a large number of labels need to be created at a time.

The tape roll from which the second printing tape 213 is to be reeled out is supposed to be used in combination with the ribbon cartridge 201. Therefore, a tape roll and a ribbon cartridge 201 are sold together as a bundled set. For this reason, the length of the second printing tape 213 on a new tape roll that has never been used is approximately the same as the length of the second ink ribbon 217 housed in a new ribbon cartridge 201 that has never been used.

Cartridge Attachment Portion

As illustrated in FIG. 4, the cartridge attachment portion 7 has a recessed shape with an opening in the +Z direction. A head unit 19 is provided on the bottom of the cartridge attachment portion 7, that is, on an attachment bottom surface 17 that is a −Z-side inner surface, in such a way as to protrude in the +Z direction. The head unit 19 includes a thermal head 21 and a head cover 23. At least the +X-direction, the −Y-direction, and the +Z-direction of the thermal head 21 is covered by the head cover 23. The head cover 23 protrudes in the +Z direction to the same extent as that of a platen shaft 25 described later. The head cover 23 is inserted into the first head insertion hole 119 so as to guide the attachment of the tape cartridge 101 in the process of the user's attaching the tape cartridge 101 to the cartridge attachment portion 7. The head cover 23 is inserted into the second head insertion hole 219 so as to guide the attachment of the ribbon cartridge 201 in the process of the user's attaching the ribbon cartridge 201 to the cartridge attachment portion 7.

The platen shaft 25, a first reeling shaft 29, a first unreeling shaft 27, a second unreeling shaft 31, and a second reeling shaft 33 are provided on the attachment bottom surface 17 in this order as viewed from the −X-direction in such a way as to protrude in the +Z direction.

The platen shaft 25 is provided at a +Y-directional position with respect to the thermal head 21. When the user attaches the tape cartridge 101 to the cartridge attachment portion 7, the platen shaft 25 is inserted into the first platen roller 105 so as to cooperate with the head cover 23 for guiding the attachment of the tape cartridge 101. When the user attaches the ribbon cartridge 201 to the cartridge attachment portion 7, the platen shaft 25 is inserted into the second platen roller 205 so as to cooperate with the head cover 23 for guiding the attachment of the ribbon cartridge 201. The direction in which the tape cartridge 101 or the ribbon cartridge 201 is attached is parallel to the direction in which the platen shaft 25 extends, that is, the Z axis.

When the tape cartridge 101 is attached to the cartridge attachment portion 7, as illustrated in FIG. 1, the platen shaft 25, the first unreeling shaft 27, and the first reeling shaft 29 are inserted into the first platen roller 105, the first unreeling core 107, and the first reeling core 109 respectively. When the attachment portion cover 5 is closed in this state, the thermal head 21 is driven by a non-illustrated head movement mechanism to move toward the platen shaft 25. Due to this head movement, the first printing tape 113 and the first ink ribbon 117 are nipped between the thermal head 21 and the first platen roller 105. The tape printing apparatus 1 performs printing on the first printing tape 113 by causing the thermal head 21 to generate heat while feeding the first printing tape 113 and the first ink ribbon 117 ahead by rotating the first platen roller 105.

When the ribbon cartridge 201 is attached to the cartridge attachment portion 7, as illustrated in FIG. 2, the platen shaft 25, the second unreeling shaft 31, and the second reeling shaft 33 are inserted into the second platen roller 205, the second unreeling core 207, and the second reeling core 209 respectively. When the attachment portion cover 5 is closed in this state, the thermal head 21 is driven by the head movement mechanism to move toward the platen shaft 25. Due to this head movement, the second printing tape 213 and the second ink ribbon 217 are nipped between the thermal head 21 and the second platen roller 205. The tape printing apparatus 1 performs printing on the second printing tape 213 by causing the thermal head 21 to generate heat while feeding the second printing tape 213 and the second ink ribbon 217 ahead by rotating the second platen roller 205.

The circuit board connection portion 51 is provided on, of the cartridge attachment portion 7, an inner surface located on the +X-direction of a common attachment area 37 for the tape cartridge 101 and the ribbon cartridge 201. When the tape cartridge 101 is attached to the cartridge attachment portion 7, the circuit board connection portion 51 is connected to the first circuit board 100 provided on the tape cartridge 101 (see FIG. 5). When the ribbon cartridge 201 is attached to the cartridge attachment portion 7, the circuit board connection portion 51 is connected to the second circuit board 200 provided on the ribbon cartridge 201 as illustrated in FIG. 6.

The circuit board connection portion 51 is configured to read cartridge information from the first circuit board 100 and the second circuit board 200. The cartridge information includes tape/ribbon information and the amount of the tape used. The tape/ribbon information is information that has been stored in advance in the first circuit board 100 of the tape cartridge 101 and the second circuit board 200 of the ribbon cartridge 201 and is not rewritable on the tape printing apparatus 1. The amount of the tape used is information that is rewritable on the tape printing apparatus 1.

The first circuit board 100 stores, as the tape/ribbon information, information about the first printing tape 113 and the first ink ribbon 117 that are housed in the tape cartridge 101 provided with the first circuit board 100. In addition, the first circuit board 100 stores, as the amount of the tape used, a length that is calculated by adding a leading-end blank-space length and a trailing-end blank-space length in the length direction of the first printing tape 113 to the length of the already-printed portion of the first printing tape 113. The second circuit board 200 stores, as the tape/ribbon information, information about the second printing tape 213 on the tape roll sold together with the ribbon cartridge 201 as a bundled set and about the second ink ribbon 217 housed in the ribbon cartridge 201 provided with the second circuit board 200. In addition, the second circuit board 200 stores, as the amount of the tape used, a length that is calculated by adding a leading-end blank-space length and a trailing-end blank-space length in the length direction of the second printing tape 213 to the length of the already-printed portion of the second printing tape 213.

In the description below, a simpler term "printing tape" will be used when it is unnecessary to distinguish the first printing tape 113 and the second printing tape 213 from each other. In the description below, a simpler term "circuit board" will be used when it is unnecessary to distinguish the first circuit board 100 and the second circuit board 200 from each other.

Control Configuration of Tape Printing Apparatus

Figure 7:
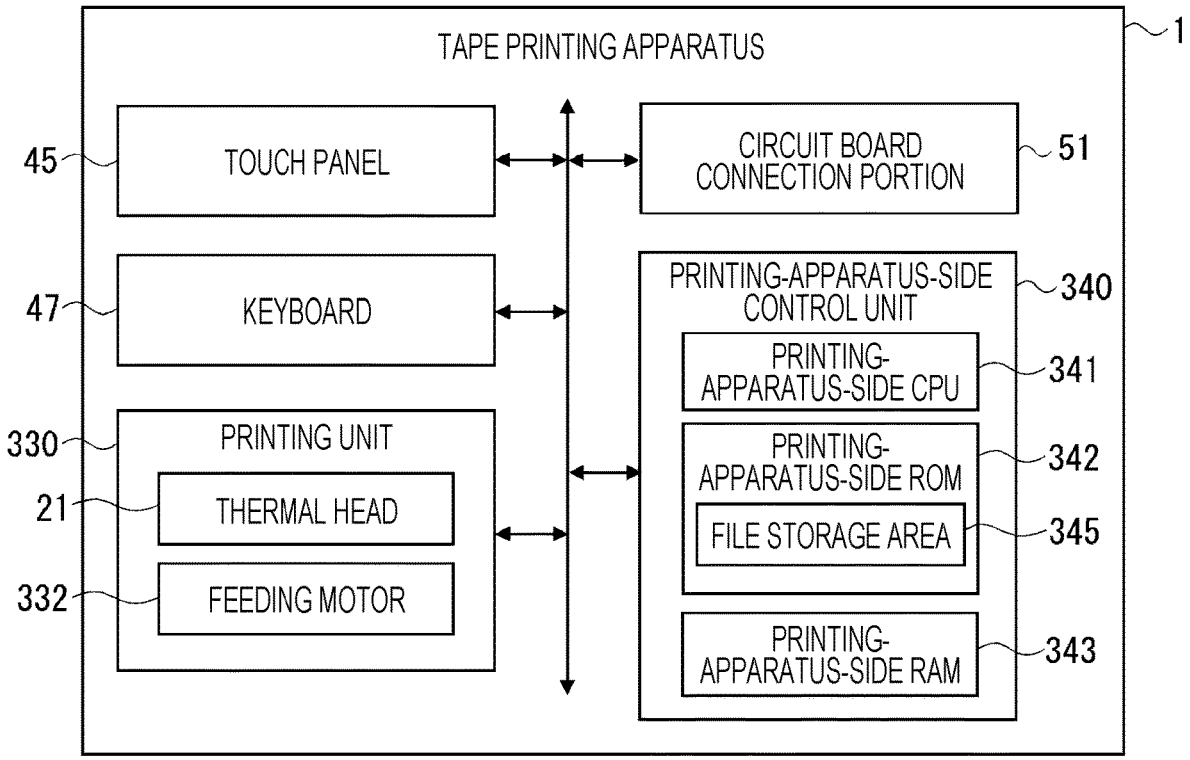
FIG. 7 is a control block diagram of the tape printing apparatus.

FIG. 7 is a control block diagram of the tape printing apparatus 1. The tape printing apparatus 1 includes the touch panel 45, the keyboard 47, a printing unit 330, the circuit board connection portion 51, and a printing-apparatus control unit 340. The touch panel 45 is an example of a "display unit".

The touch panel 45 is configured to display various kinds of screen such as those described later including an edit screen D1 illustrated in FIG. 12, a file menu screen D2 illustrated in FIG. 13, and a file open screen D3 illustrated in FIG. 14. The touch panel 45 is used also for various kinds of operation, for example, menu selection and text file selection.

The keyboard 47 is used for inputting various kinds of information, for example, for inputting a text. The "text" contains characters such as Japanese hiragana characters and alphabets and further contains numerals and symbols. The keyboard 47 includes function keys such as UP, DOWN, LEFT, and RIGHT keys, a Select key, a Delete key, an Edit key, and a Print key, etc. The function keys will be described later.

The printing unit 330 is a mechanism for performing printing on a printing tape. The printing unit 330 includes the thermal head 21 and a feeding motor 332. The thermal head 21 includes a plurality of heat generating elements and performs printing by thermal transfer of ink from the ink ribbon to the printing tape. The feeding motor 332 serves as a driver that drives the first platen roller 105 if the cartridge attached to the cartridge attachment portion 7 is the tape cartridge 101. The feeding motor 332 serves as a driver that drives the second platen roller 205 if the cartridge attached to the cartridge attachment portion 7 is the ribbon cartridge 201.

The circuit board connection portion 51 is configured to be connected to a circuit board and write the amount of the tape used into the circuit board and read cartridge information out of the circuit board. As explained above, the tape printing apparatus 1 writes the amount of the tape used into the circuit board of the tape cartridge 101 or the ribbon cartridge 201. Therefore, it is possible to manage the amount of the tape used also when the tape cartridge 101 or the ribbon cartridge 201 that was used by another tape printing apparatus 1 is attached to the tape printing apparatus 1.

As described above, the cartridge information includes tape/ribbon information. The tape/ribbon information includes tape information that indicates the type of the printing tape. Based on the tape information, the tape printing apparatus 1 determines the type of the printing tape. Determining the type of the printing tape based on the tape information read by the circuit board connection portion 51 will be hereinafter referred to as "detect the type of the printing tape".

The tape information includes information that indicates the type of the printing tape, information that indicates the width of the printing tape, information that indicates the color of the printing tape, and information that indicates the material of the printing tape, etc. Examples of the material of the printing tape are PET, paper, cloth, or magnet. The "information that indicates the type of the printing tape" will be hereinafter referred to as "tape type information". The "information that indicates the width of the printing tape" will be hereinafter referred to as "tape width information".

The tape information further includes information that indicates the length of the first printing tape 113 housed in a newt tape cartridge 101 that has never been used or information that indicates the length of the second printing tape 213 on a new tape roll that has never been used. The "length of the first printing tape 113 housed in a new tape cartridge 101 that has never been used" and the "length of the second printing tape 213 on a new tape roll that has never been used" will be hereinafter referred to as "unused tape length".

Figure 9:
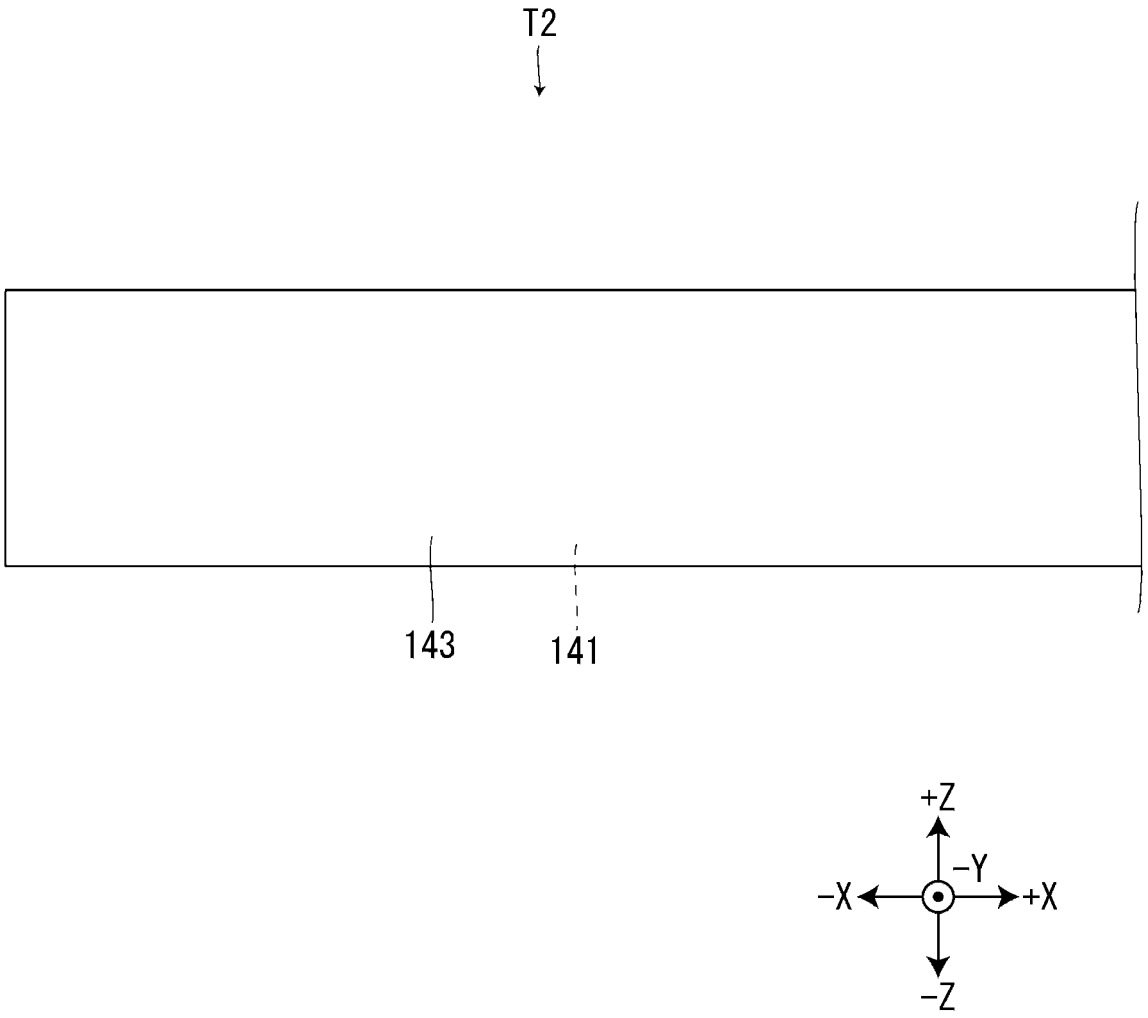
FIG. 9 is a diagram that illustrates a continuous tape.

In the present embodiment, the tape type indicates whether the tape is a die cut tape T1 illustrated in FIG. 8 or a continuous tape T2 illustrated in FIG. 9. The die cut tape T1 is an example of a "first printing tape". The continuous tape T2 is an example of a "second printing tape".

As illustrated in FIG. 8, the die cut tape T1 is a printing tape that includes a plurality of medium labels 133 stuck to an elongated releasing-paper tape 131, wherein the plurality of medium labels 133 serves as a printing layer. The plurality of medium labels 133 is stuck to the releasing-paper tape 131 at approximately equally spaced intervals therebetween in the X axis, that is, the length direction of the releasing-paper tape 131. All of the plurality of medium labels 133 have the same shape and size and are stuck to the releasing-paper tape 131 in such a way as to be able to be peeled off therefrom.

The releasing-paper tape 131 has a plurality of detection tabs 139 along its +Z-directional edge. Each of the plurality of detection tabs 139 is a part sticking out from the +Z-directional edge of the releasing-paper tape 131. The detection tabs 139 are provided at approximately equally spaced intervals therebetween in the length direction of the releasing-paper tape 131. The detection tab 139 has a substantially rectangular shape whose longer side extends in the length direction of the die cut tape T1. The detection tab 139 is provided for each of the plurality of medium labels 133. The detection tab 139 is detected by the aforementioned sensor 6 illustrated in FIG. 1, etc. That is, in a state in which the attachment portion cover 5 is closed, the sensor 6 detects the detection tab 139 of the die cut tape T1 exposed at the exposure area 241 of the second cartridge case 211 of the ribbon cartridge 201.

As illustrated in FIG. 9, the continuous tape T2 is a printing tape that includes an elongated label tape 143 stuck to an elongated releasing-paper tape 141, wherein the elongated label tape 143 serves as a printing layer. That is, the continuous tape T2 is a printing tape that has a continuous layered structure made up of the releasing-paper tape 141 and the label tape 143.

In the present embodiment, it is assumed that the continuous tape T2 is used as the first printing tape 113 housed in the tape cartridge 101, and it is assumed that either the die cut tape T1 or the continuous tape T2 is used selectively as the second printing tape 213 reeled out from a tape roll.

Either the die cut tape T1 or the continuous tape T2 may be used selectively as the first printing tape 113, similarly to the second printing tape 213. The only thing needed for this configuration is to just add, in the +Z-directional surface of the first cartridge case 111 of the tape cartridge 101, an exposure area where the detection tab 139 of the die cut tape T1 is to be exposed.

The printing-apparatus control unit 340 includes a printing-apparatus CPU 341, a printing-apparatus ROM 342, and a printing-apparatus RAM 343.

The printing-apparatus CPU 341 performs various kinds of control by loading various kinds of control program stored in the printing-apparatus ROM 342 into the printing-apparatus RAM 343 and running the loaded program. The printing-apparatus control unit 340 may use a hardware circuit such as ASIC as a processor in place of the printing-apparatus CPU 341. One or more CPUs and one or more hardware circuits such as ASIC may cooperate to behave as the processor.

The printing-apparatus ROM 342 stores various kinds of control program and various kinds of control data. The printing-apparatus RAM 343 is used as a work area for performing various kinds of control by the printing-apparatus CPU 341.

The printing-apparatus ROM 342 includes, for example, a file storage area 345. The file storage area 345 is an example of a "storage unit". FIG. 10 is a diagram that illustrates an example of file data stored in the file storage area 345. The file data is data in which text files are associated with tape information. The text file is a file that contains a text.

The tape printing apparatus 1 associates the text file created on the edit screen D1 described later with the tape information included in the cartridge information read out of the circuit board, and stores the text file in association with the tape information into the file storage area 345. A user is able to create a label by selecting a text file for which the user wants to create the label from among a plurality of text files stored in the file storage area 345. The label is a print output that is created by printing, on a printing tape, a print image that is based on print data generated using the text file.

Tape type information and tape width information are stored as the tape information in the file storage area 345. For example, the file data in the top row of the table illustrated in FIG. 10 indicates that the tape information read out of the circuit board when the text file "5555" was saved includes tape type information "die cut tape" and tape width information "24 mm".

The printing-apparatus CPU 341 generates print data using the control programs stored in the printing-apparatus ROM 342 and, based on the generated print data, performs printing on a printing tape. More specifically, the printing-apparatus CPU 341 performs printing by controlling, based on the generated print data, the supply of electricity to the plurality of heat generating elements provided in the thermal head 21 and the driving of the feeding motor 332, in a linked manner.

Functional Configuration of Tape Printing Apparatus

Figure 11:
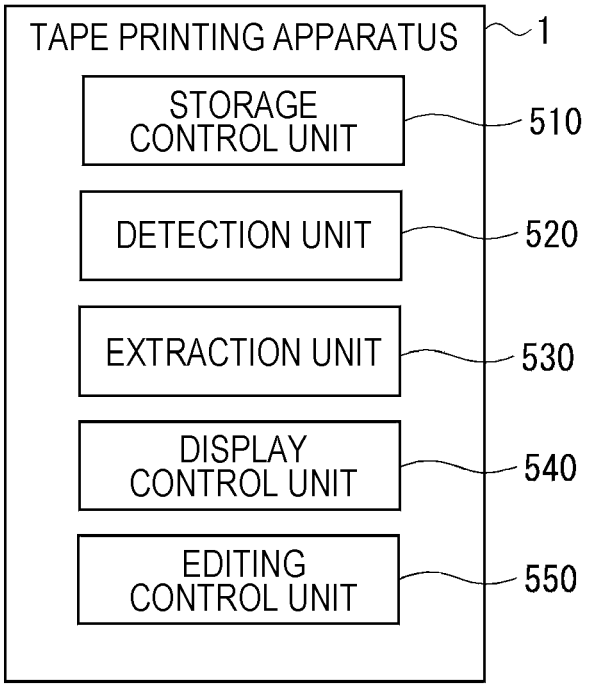
FIG. 11 is a functional block diagram of the tape printing apparatus.

FIG. 11 is a functional block diagram of the tape printing apparatus 1. The tape printing apparatus 1 includes a storage control unit 510, a detection unit 520, an extraction unit 530, a display control unit 540, and an editing control unit 550. These functions are realized by running the control programs stored in the printing-apparatus ROM 342 by the printing-apparatus CPU 341.

When an instruction for saving a text file is received from a user, the storage control unit 510 stores file data in which the text file is associated with tape information into the file storage area 345. The "instruction for saving a text file" will be hereinafter referred to as "file save instruction". The tape information is information that indicates the type of a printing tape that is the target of printing, on which printing is to be performed, when the user instructs that the text file should be saved. The "printing tape that is the target of printing" is the first printing tape 113 housed in the tape cartridge 101 if the cartridge attached to the cartridge attachment portion 7 is the tape cartridge 101. The "printing tape that is the target of printing" is the second printing tape 213 fed in from the tape roll if the cartridge attached to the cartridge attachment portion 7 is the ribbon cartridge 201.

The detection unit 520 detects the type of the printing tape that is the target of printing by reading the tape information out of the circuit board via the circuit board connection portion 51. Based on the tape type information included in the tape information, the detection unit 520 detects whether the printing tape is a die cut tape T1, in which a printable area where printing can be performed is pre-determined in its printing layer, or a continuous tape T2, in which the printable area is not pre-determined in its printing layer. The "printable area" means each area of the medium labels 133 stuck to the releasing-paper tape 131 of the die cut tape T1 at equal intervals. Since the printable area of the die cut tape T1 is pre-determined as described here, as its feature, the number of text letters and the number of text lines that can be printed are limited, depending on the shape and size of the printable area.

When an instruction for opening a text file is received from the user, the extraction unit 530 extracts, from the file storage area 345, text files associated with the tape type information that indicates the type of the printing tape detected by the detection unit 520 as the target of printing. More specifically, the text files extracted by the extraction unit 530 in a case where the die cut tape T1 is detected as the tape type by the detection unit 520 are different from the text files extracted by the extraction unit 530 in a case where the continuous tape T2 is detected as the tape type by the detection unit 520. The "instruction for opening a text file" will be hereinafter referred to as "file open instruction".

Figure 14:
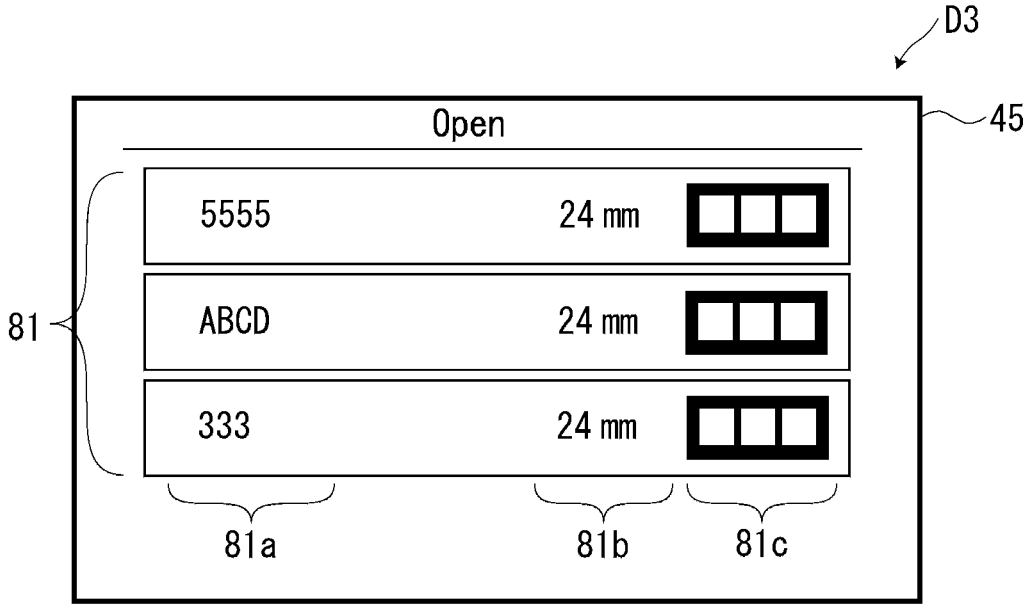
FIG. 14 is a diagram that illustrates a display example of a file open screen when the printing tape that is the target of printing is a die cut tape.

The display control unit 540 displays the text files extracted by the extraction unit 530 on the file open screen D3 illustrated in FIG. 14, etc. as candidates from among which a text file that is to be printed on the printing tape is to be selected. The "candidates from among which the text file is to be selected" will be hereinafter referred to as "file candidates". When this candidate display is performed, the display control unit 540 displays texts that are contained in the text files as the file candidates in a text area 81*a* of the file open screen D3 illustrated in FIG. 14. Upon receiving a scroll operation on the file open screen D3, the display control unit 540 scrolls the file candidates displayed thereon.

In a state in which the file candidates are displayed on the file open screen D3, the editing control unit 550 accepts the editing of a text included in a text file, and updates the text-edited text file. That is, upon receiving an input for editing a text on the file open screen D3, the editing control unit 550 updates the text file that contains this text in the file storage area 345.

Edit Screen, File Menu Screen, and File Open Screen

Figure 12:
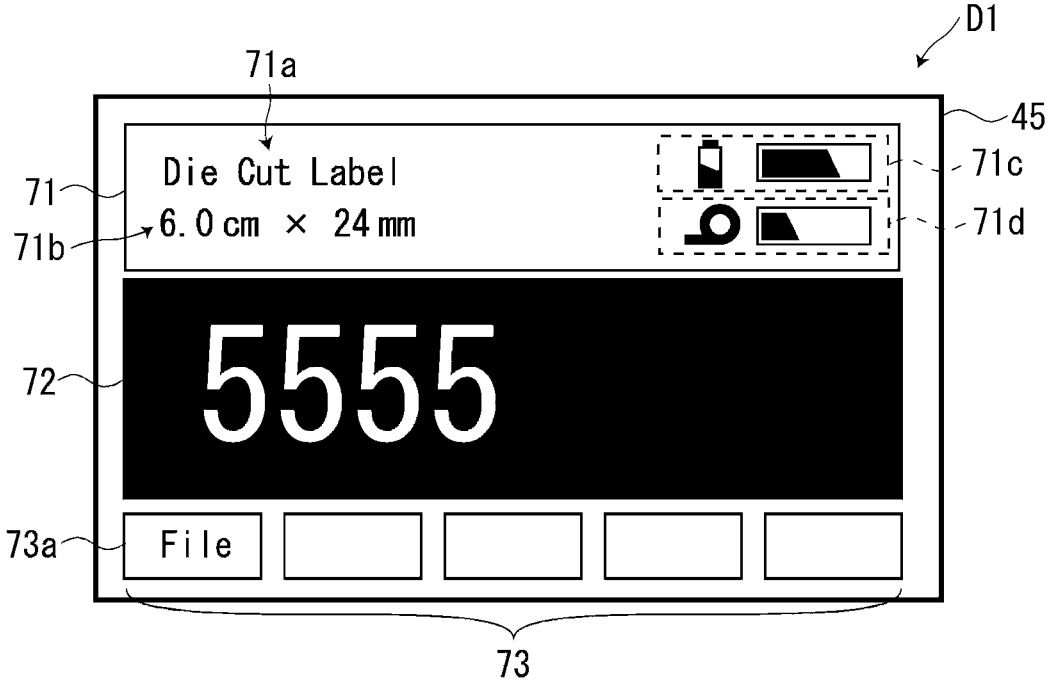
FIG. 12 is a diagram that illustrates a display example of an edit screen.

FIG. 12 is a diagram that illustrates a display example of the edit screen D1. The edit screen D1 includes an information display area 71, an edit area 72, and a button area 73.

Label type information 71*a*, label size information 71*b*, amount-of-battery-left information 71*c*, and amount-of-tape-left information 71*d* are displayed in the information display area 71. The label type information 71*a* is information that indicates a label type displayed based on the tape type information included in the tape/ribbon information read out of the circuit board. The label type information 71*a* is displayed as "Die Cut Label" if the tape type information indicates the die cut tape T1. The label type information 71*a* is displayed as "General Label" if the tape type information indicates the continuous tape T2.

The label size information 71*b* is information that indicates the size of a label created by the tape printing apparatus 1. The label size information 71*b* includes label length information, which indicates the length of the label, and label width information, which indicates the width of the label. The tape printing apparatus 1 displays the label width information as a part of the label size information 71*b*, based on the tape width information. The tape printing apparatus 1 calculates the label length based on the content of editing in the edit area 72 and displays the label length information that indicates the calculated label length as a part of the label size information 71.

The amount-of-battery-left information 71*c* is information that indicates the amount of battery left on the tape printing apparatus 1 when the tape printing apparatus 1 is driven by battery power, not by AC power. The amount-of-battery-left information 71*c* includes a battery icon that is a graphic symbol of a battery and a battery level indicator. The battery level indicator is displayed such that a deep-color bar area inside a rectangle becomes smaller and shorter as the amount of battery left decreases.

The amount-of-tape-left information 71*d* is information that indicates the amount of the printing tape left. The tape printing apparatus 1 displays the amount-of-tape-left information 71*d* based on the unused tape length included in the tape information and based on the amount of the tape used. That is, the tape printing apparatus 1 calculates the amount of the tape left by subtracting the amount of the tape used from the unused tape length. The amount-of-tape-left information 71*d* includes a tape icon that is a graphic symbol of a printing tape and a tape remaining-amount indicator. The tape remaining-amount indicator is displayed such that a deep-color bar area inside a rectangle becomes smaller and shorter as the amount of the tape left decreases.

When text editing is performed, for example, a text inputted using the keyboard 47 is displayed in the edit area 72. When a text file is selected on the file open screen D3 illustrated in FIG. 14, etc., which will be described later, the tape printing apparatus 1 displays the selected text file in the edit area 72. When the user performs an operation for editing the text, the tape printing apparatus 1 reflects the result of editing into display on the edit area 72.

Various function buttons are displayed in the button area 73. The function buttons include a file button 73*a* for opening the file menu screen D2 as illustrated in FIG. 13. In addition to the file button 73*a*, the function buttons include buttons for specifying edit functions such as changing text size, font size, etc. The tape printing apparatus 1 receives a button selection by, for example, detecting a tap operation at the position where a button of the touch panel 45 is displayed. In addition, the tape printing apparatus 1 receives a button selection by detecting an operation of the UP, DOWN, LEFT, and RIGHT keys of the keyboard 47 and an operation of the Select key thereof. Other buttons and selection candidates are selectable by performing similar operations.

Figure 13:
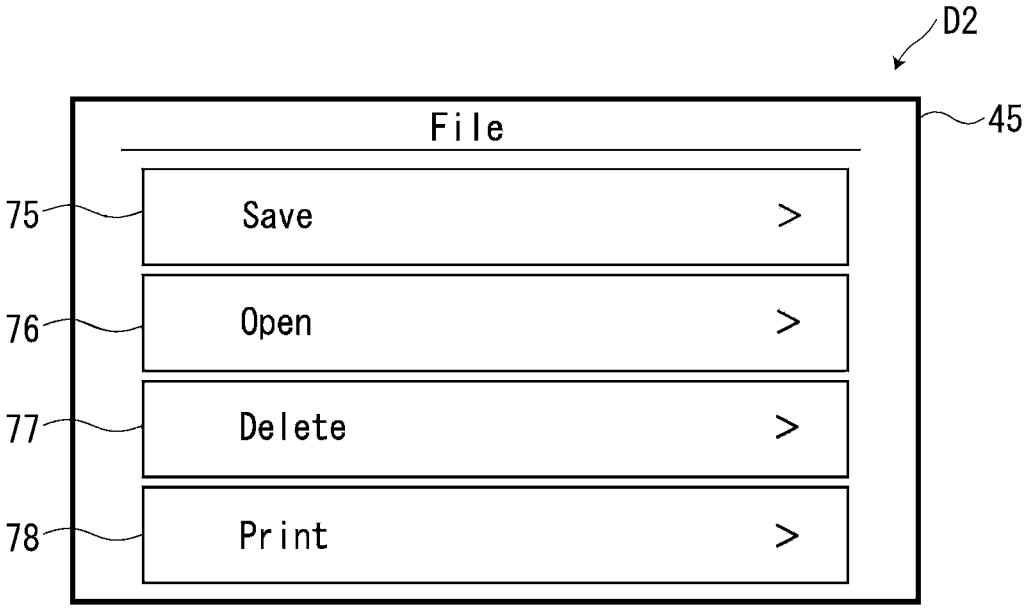
FIG. 13 is a diagram that illustrates a display example of a file menu screen.

FIG. 13 is a diagram that illustrates a display example of the file menu screen D2. The file menu screen D2 includes a Save button 75, an Open button 76, a Delete button 77, and a Print button 78.

The Save button 75 is a button for saving a text file. When the Save button 75 is selected, the tape printing apparatus 1 stores, into the file storage area 345, file data in which a text file prepared by formatting the text edited on the edit screen D1 into a file form is associated with tape information that indicates the type of the printing tape detected when the Save button 75 is selected.

The Open button 76 is a button for opening a text file. The tape printing apparatus 1 displays the file open screen D3 when the Open button 76 is selected.

The Delete button 77 is a button for deleting a text file. The tape printing apparatus 1 displays a file deletion screen, which is not illustrated, when the Delete button 77 is selected. The file deletion screen displays a list of all of the text files that are stored in the file storage area 345. The user selects a text file which the user wants to be deleted from among the text files in the list. Upon detecting that a text file is selected on the file deletion screen, the tape printing apparatus 1 deletes the file data that contains the selected text file from the file storage area 345.

The Print button 78 is a button for instructing that printing should be performed. When the Print button 78 is selected, the tape printing apparatus 1 generates print data based on the result of editing on the edit screen D1 and then performs printing based on the generated print data.

FIG. 14 is a diagram that illustrates a display example of the file open screen D3. Specifically, this drawing illustrates a display example of the file open screen D3 when the printing tape that is the target of printing is the die cut tape T1. The file open screen D3 displays a file candidate group 81. The file candidate group 81 includes one or more file candidates.

The tape printing apparatus 1 detects the type of the printing tape that is the target of printing, and extracts, from the file storage area 345, text files associated with the tape type information that indicates the detected type of the printing tape, and then displays the extracted text files as the file candidates. For example, if the file data illustrated in FIG. 10 is stored in the file storage area 345 and further if the type of the printing tape that is the target of printing is the die cut tape T1, the tape printing apparatus 1 displays the file candidate group 81 that includes, as the file candidates, the text files associated with the tape type information that indicates the die cut tape T1 as illustrated in FIG. 14. As explained here, the tape printing apparatus 1 displays the file candidates that are suited for the tape type. Therefore, it is possible to prevent the user from selecting a text file that cannot be printed on the die cut tape T1 by mistake.

Each of the file candidates that are included in the file candidate group 81 includes a text area 81*a* for displaying the text contained in the text file, a tape width area 81*b* for displaying the tape width based on the tape width information, and a tape type area 81*c* for displaying the tape type based on the tape type information. If the type of the printing tape that is the target of printing is the die cut tape T1, an image that is a graphic symbol of the die cut tape T1 is displayed as the tape type in the tape type area 81*c*.

The tape printing apparatus 1 scrolls the file candidates up or down when a scroll operation is performed on the file open screen D3. The tape printing apparatus 1 receives a swipe operation and a flick operation on the touch panel 45 as the scroll operation. Therefore, even if file candidates that are too many to be displayed on the file open screen D3 at a time are extracted, scrolling enables the tape printing apparatus 1 to present all of the file candidates to the user.

If, after selecting any one of the file candidates included in the file candidate group 81, the user operates the Edit key of the keyboard 47 with the file candidate selected, the tape printing apparatus 1 puts the text included in the text file into an editable state.

Figure 15:
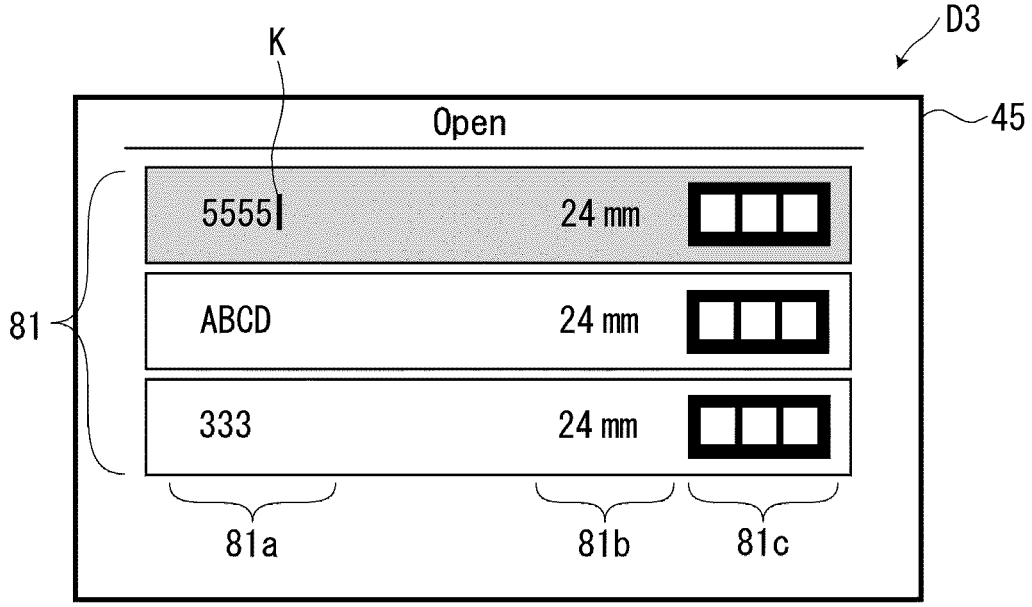
FIG. 15 is a diagram that illustrates a display example of the file open screen when the user operates an Edit key after selecting the top one of the file candidates on the file open screen illustrated in FIG. 14.

FIG. 15 is a diagram that illustrates a display example of the file open screen D3 when the user operates the Edit key after selecting the top one of the file candidates on the file open screen D3 illustrated in FIG. 14. In this case, the tape printing apparatus 1 performs display such that a cursor K is added after the last character of the text included in the text file in the text area 81*a* of the selected file candidate. The cursor K indicates an edit position. Upon receiving an operation of the UP, DOWN, LEFT, and RIGHT keys of the keyboard 47, the tape printing apparatus 1 moves the cursor K to change its position on the text. The tape printing apparatus 1 moves the cursor K also when character inputting or character deletion is performed on the text.

As explained above, the tape printing apparatus 1 according to the present embodiment presents display such that the text included in the text file is editable on the file open screen D3 on which the file candidates are displayed. If the editing of the text file is performed in the text area 81*a* of the file open screen D3, the tape printing apparatus 1 reflects the result of the editing into the file data stored in the file storage area 345. Because of this configuration, the user does not have to follow troublesome steps of selecting the text file that is the target of editing on the file open screen D3, editing the text file on the edit screen D1 next, and finally giving an instruction to save the file on the file menu screen D2.

When the selection of the file candidate is deselected after the user's editing the text file, the tape printing apparatus 1 reflects the result of the editing of the text file into the file data stored in the file storage area 345. Upon deselection of the selection of the file candidate, the tape printing apparatus 1 exits from the edit state and makes the cursor K disappear. "When the selection of the file candidate is deselected"

means, for example, "when any other file candidate is selected" or "when the Print key included in the keyboard 47 is selected", etc.

If the user selects any one of the file candidates included in the file candidate group 81 by operating the UP key or the DOWN key included in the keyboard 47 on the file open screen D3 and then operates a predetermined key other than the Select key such as the Edit key, with the file candidate selected, the tape printing apparatus 1 displays the selected text file on the edit screen D1. If the user selects any one of the file candidates included in the file candidate group 81 by operating the UP key or the DOWN key included in the keyboard 47 and then operates the Print key, with the file candidate selected, the tape printing apparatus 1 generates print data based on the selected text file and then prints out the generated print data on the printing tape.

Figure 16:
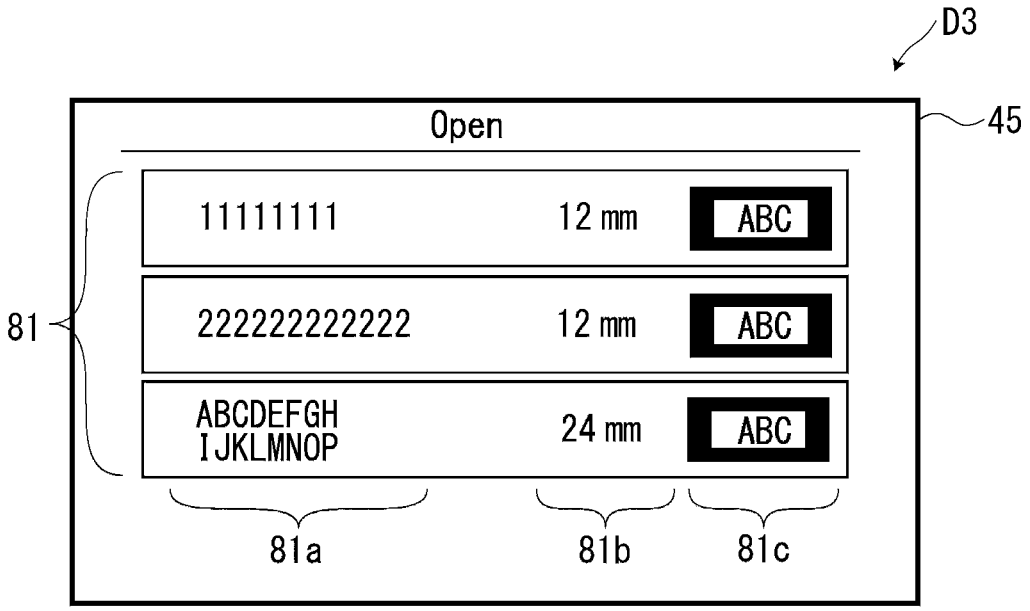
FIG. 16 is a diagram that illustrates a display example of a file open screen when the printing tape that is the target of printing is a continuous tape.

FIG. 16 illustrates a display example of the file open screen D3 when the printing tape that is the target of printing is the continuous tape T2. For example, if the file data illustrated in FIG. 10 is stored in the file storage area 345 and further if the type of the printing tape that is the target of printing is the continuous tape T2, the tape printing apparatus 1 displays the file candidate group 81 that includes, as the file candidates, the text files associated with the tape type information that indicates the continuous tape T2 as illustrated in FIG. 16. In this case, an image that is a graphic symbol of the continuous tape T2 is displayed as the tape type in the tape type area 81*c*.

File Save Processing

Figure 17:
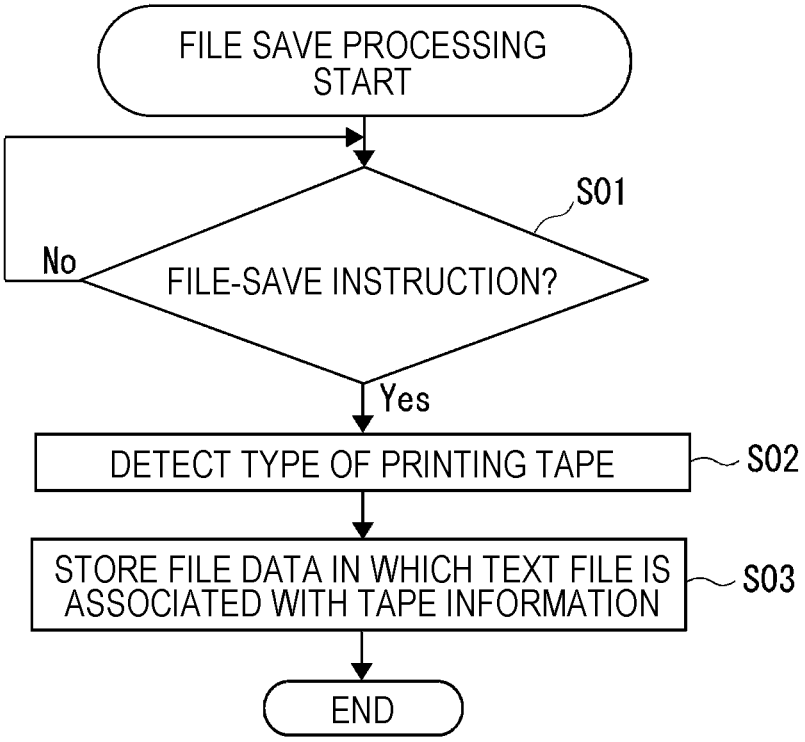
FIG. 17 is a flowchart that illustrates the flow of file save processing.

FIG. 17 is a flowchart that illustrates the flow of file save processing. The tape printing apparatus 1 starts S02 and the subsequent step of file save processing when triggered by selection of the Save button 75 on the file menu screen D2.

In S01, the tape printing apparatus 1 determines whether an instruction to save the file is given or not, that is, whether the Save button 75 is selected on the file menu screen D2 or not. The process proceeds to S02 if the tape printing apparatus 1 determines that an instruction to save the file is given. The step S01 is repeated if the tape printing apparatus 1 determines that an instruction to save the file is not given.

In S02, the tape printing apparatus 1 detects the type of the printing tape. By performing this detection, the tape printing apparatus 1 acquires tape information that includes tape type information and tape width information.

In S03, the tape printing apparatus 1 stores, into the file storage area 345, file data in which the save-instructed text file is associated with the tape information that indicates the type of the printing tape detected in S02.

File Candidate Display Processing

Figure 18:
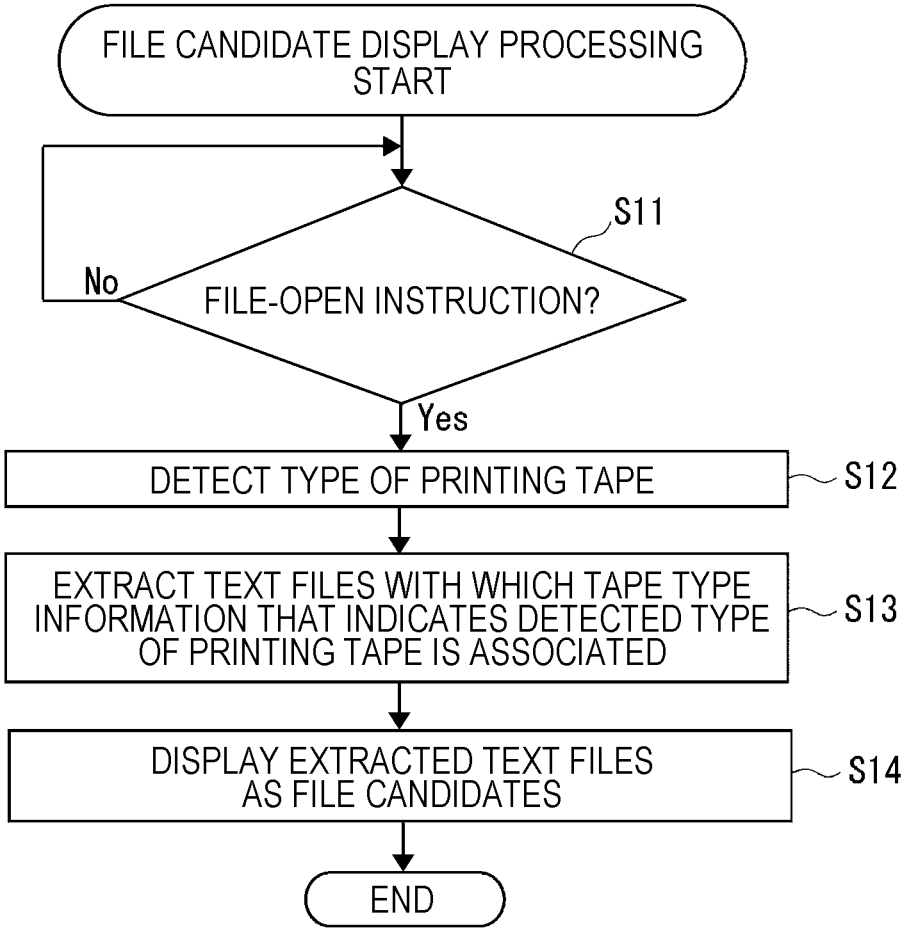
FIG. 18 is a flowchart that illustrates the flow of file candidate display processing.

FIG. 18 is a flowchart that illustrates the flow of file candidate display processing. The tape printing apparatus 1 starts S12 and the subsequent steps of file candidate display processing when triggered by selection of the Open button 76 on the file menu screen D2.

In S11, the tape printing apparatus 1 determines whether a file-open instruction is given or not, that is, whether the Open button 76 is selected or not. The process proceeds to S12 if the tape printing apparatus 1 determines that a file-open instruction is given. The step S11 is repeated if the tape printing apparatus 1 determines that a file-open instruction is not given.

In S12, the tape printing apparatus 1 detects the type of the printing tape. By performing this detection, the tape printing apparatus 1 acquires at least tape type information.

In S13, the tape printing apparatus 1 extracts, from the file storage area 345, text files with which the tape type information that indicates the type of the printing tape detected in S12 is associated.

In S14, the tape printing apparatus 1 displays the text files extracted in S13 on the file open screen D3 as file candidates.

As explained above, the tape printing apparatus 1 according to the present embodiment detects the tape type as the type of the printing tape, and extracts, from the file storage area 345, text files associated with the tape type information that indicates the detected tape type, and then displays the extracted text files as the file candidates on the file open screen D3. This makes it possible to prevent the user from selecting a text file that cannot be printed on the printing tape by mistake.

Upon receiving a scroll operation on the file open screen D3, the tape printing apparatus 1 scrolls the file candidates displayed thereon. This enables the user to select a text file quickly.

The tape printing apparatus 1 accepts the editing of text on the file open screen D3. This saves the user the trouble of switching from the file open screen D3 to the edit screen D1 when the editing is performed.

Moreover, the tape printing apparatus 1 performs file candidate display such that the file candidates that are displayed when the printing tape that is the target of printing is the die cut tape T1 are different from the file candidates that are displayed when the printing tape that is the target of printing is the continuous tape T2. This enables the user to select a text file that is suited for the type of the printing tape. For example, a print error will occur if a text file containing a long text generated for the continuous tape T2 is selected when the printing tape that is the target of printing is the die cut tape T1. In this respect, the disclosed technique makes it possible to prevent the user from selecting a text file that cannot be printed by mistake because only text files generated for the die cut tape T1 are displayed as file candidates.

The scope of the present disclosure is not limited to the embodiments described above. Any of the modification examples described below may be adopted.

First Modification Example

In the foregoing embodiments, file save processing and file candidate display processing are executed on the tape printing apparatus 1. However, the file save processing and the file candidate display processing may be executed on an electronic device other than the tape printing apparatus 1. For example, the file save processing and the file candidate display processing may be executed on a portable terminal 400 such as a smartphone or a tablet terminal, etc.

Figure 19:
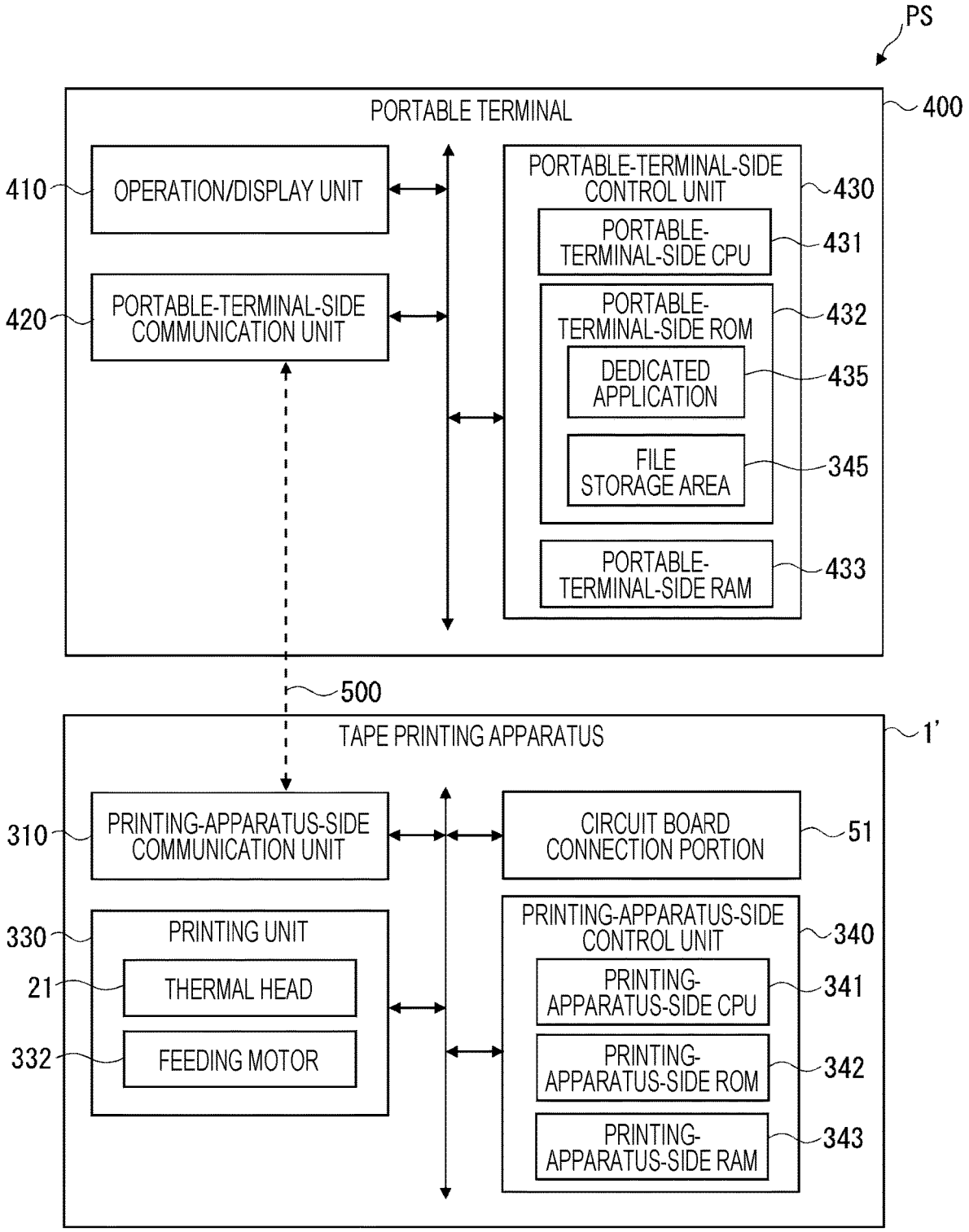
FIG. 19 is a control block diagram of a printing system according to a modification example.

FIG. 19 is a control block diagram of a printing system PS according to a first modification example. The printing system PS includes the portable terminal 400 and a tape printing apparatus 1'. The portable terminal 400 and the tape printing apparatus 1' are connected to each other via wireless communication 500. The portable terminal 400 is an example of an "information processing apparatus". The portable terminal 400 and the tape printing apparatus 1' may be connected to each other via wired communication, for example, via a cable, in place of the wireless communication 500.

The portable terminal 400 includes an operation/display unit 410, a portable-terminal communication unit 420, and a portable-terminal control unit 430. The portable-terminal communication unit 42 is an example of a "receiving unit". The operation/display unit 410 is, for example, a touch panel. The operation/display unit 410 displays various kinds of screen such as the edit screen D1, the file menu screen D2, and the file open screen D3 and receives various kinds of operation by a user.

The portable-terminal communication unit 420 communicates with the tape printing apparatus 1' via the wireless communication 500. For example, the portable-terminal communication unit 420 transmits print data to the tape printing apparatus 1' and receives cartridge information from the tape printing apparatus 1'.

The portable-terminal control unit 430 includes a portable-terminal CPU (Central Processing Unit) 431, a portable-terminal ROM (Read Only Memory) 432, and a portable-terminal RAM (Random Access Memory) 433.

The portable-terminal CPU 431 performs various kinds of control by loading various kinds of control program stored in the portable-terminal ROM 432 into the portable-terminal RAM 433 and running the loaded program. The portable-terminal control unit 430 may use a hardware circuit such as ASIC (Application Specific Integrated Circuit) as a processor in place of the portable-terminal CPU 431. One or more CPUs and one or more hardware circuits such as ASIC may cooperate to behave as the processor.

The portable-terminal ROM 432 stores various kinds of control program and various kinds of control data. For example, the portable-terminal ROM 432 stores a dedicated application 435 for controlling the tape printing apparatus 1'. The dedicated application 435 is an example of a program. The portable-terminal ROM 432 includes the file storage area 345.

The portable-terminal CPU 431 generates print data by using the dedicated application 435. The portable-terminal CPU 431 realizes the functions illustrated in FIG. 11 by using the dedicated application 435. In this modification example, the extraction unit 530 extracts, from the file storage area 345, text files associated with the tape type information included in the cartridge information received from the tape printing apparatus 1'.

The tape printing apparatus 1' according to this modification example includes a printing-apparatus communication unit 310, the printing unit 330, the circuit board connection portion 51, and the printing-apparatus control unit 340. The printing-apparatus communication unit 310 performs communication via the wireless communication 500. For example, the printing-apparatus communication unit 310 transmits the cartridge information read by the circuit board connection portion 51 to the portable terminal 400. Based on the print data transmitted from the portable terminal 400, the printing-apparatus control unit 340 causes the printing unit 330 to perform printing on a printing tape.

As described above, in a configuration of displaying file candidates on the portable terminal 400 and accepting the selecting of a file candidate on the portable terminal 400, the printing system PS according to the first modification example produces the same operational effects as those of the tape printing apparatus 1 according to the foregoing embodiments.

The dedicated application 435 of the portable terminal 400 according to the first modification example may be run on a server on the Internet, and the portable terminal 400 and the server may cooperate with each other to display file candidates and generate print data. A PC (Personal Computer) may be used as the information processing apparatus in place of the portable terminal 400.

Second Modification Example

In the foregoing embodiments, the tape printing apparatus 1 extracts text files such that the text files extracted when the die cut tape T1 is detected are different from the text files extracted when the continuous tape T2 is detected. However, the text file extraction may be performed such that the text files extracted in a case of detection of a printing tape type in which a first printable area is pre-determined in the printing layer of the die cut tape T1 are different from the text files extracted in a case of detection of a printing tape type in which a second printable area different from the first printable area is pre-determined in the printing layer of the die cut tape T1. That is, the tape printing apparatus 1 may extract different text files when a die cut tape T1 with different shape and/or size of the medium label 133 is detected. Examples of the shape of the medium label 133 are a circle, an oval, a polygon, etc. In this modification example, the "information that indicates the type of a printing tape" is "information that indicates the printable area of the die cut tape T1". This configuration enables the tape printing apparatus 1 to display different text files as selection candidates, depending on the difference in the printable area pre-determined in the die cut tape T1. Therefore, even when the number of text letters and the number of text lines that can be printed are limited depending on different shape and/or size of the medium label 133, the user is able to select a text file that is suited for the printing tape that is the target of printing.

Third Modification Example

The tape printing apparatus 1 may extract text files such that the text files extracted when a printing tape having a first tape width is detected are different from the text files extracted when a printing tape having a second tape width different from the first tape width is detected. In this case, the "information that indicates the type of a printing tape" is "tape width information".

Alternatively, the tape printing apparatus 1 may extract text files such that the text files extracted when a printing tape made of a first material is detected are different from the text files extracted when a printing tape made of a second material different from the first material is detected. In this case, the "information that indicates the type of a printing tape" is "information that indicates the material of a printing tape".

Alternatively, the tape printing apparatus 1 may extract text files such that the text files extracted when a printing tape having a first tape color is detected are different from the text files extracted when a printing tape having a second tape color different from the first tape color is detected. In this case, the "information that indicates the type of a printing tape" is "information that indicates the color of a printing tape".

With the above configuration, the user is able to select a suitable text file for the tape width, the material, or the tape color of the printing tape that is the target of printing.

Fourth Modification Example

In the foregoing embodiments, the tape printing apparatus 1 accepts the editing of a text file on the file open screen D3. However, the tape printing apparatus 1 may be configured not to accept the editing of a text file on the file open screen D3. The foregoing configuration can be modified in this way by causing the tape printing apparatus 1 to accept on the file open screen D3 the selecting of a text file as the target of editing and then accept the editing of a text included in this text file on the edit screen D1.

Fifth Modification Example

In the foregoing embodiments, the tape printing apparatus 1 displays texts that are contained in text files as file candidates on the file open screen D3. However, the tape printing apparatus 1 may display the names of the text files in place of the texts. The foregoing configuration can be modified in this way by causing the tape printing apparatus 1 to receive an input of a file name and store the text file, the file name, and the tape information in association with one another into the file storage area 345 when an instruction to save the file is given.

Sixth Modification Example

In the foregoing embodiments, the tape printing apparatus 1 stores, into the file storage area 345, file data in which tape information that indicates the type of a printing tape that is the target of printing at the time of the user's giving a "save-the-file" instruction is associated with the save-instructed text file. However, the tape information may be specified by the user. That is, the tape printing apparatus 1 may store file data in which the tape information specified by the user is associated with this text file into the file storage area 345. This configuration enables the user to specify the tape information and store the file data with the specified tape information, irrespective of the printing tape that is the target of printing.

Seventh Modification Example

In the foregoing embodiments, a circuit board is provided on the tape cartridge 101 or the ribbon cartridge 201. However, an RF (Radio Frequency) tag may be attached to the tape cartridge 101 or the ribbon cartridge 201 in place of a circuit board. In this case, an RF communication unit that is not illustrated is provided on the cartridge attachment portion 7, and the tape printing apparatus 1 reads cartridge information out of the RF tag via the RF communication unit. A sticker on which a code image is printed may be attached to the tape cartridge 101 or the ribbon cartridge 201. In this case, a code image reader that is not illustrated is provided on the cartridge attachment portion 7, and the tape printing apparatus 1 reads cartridge information recorded in a code image by means of the code image reader. The code image is a two-dimensional code or a barcode.

Eighth Modification Example

In the foregoing embodiments, the tape cartridge 101 attached to the tape printing apparatus 1 is replaceable with the ribbon cartridge 201 and vice versa. However, only either one of them may be attachable. Besides the above modification examples, the foregoing embodiments may be modified within a range of not departing from the gist of the present disclosure.

ADDITIONAL REMARKS

Additional remarks are made below about a tape printing apparatus, an information processing apparatus, a method for controlling a tape printing apparatus, and a non-transitory storage medium storing a program.

The tape printing apparatus 1 includes: the printing unit 330 that performs printing on a printing tape; the storage control unit 510 that causes a storage unit to store a text file that contains a text in association with information that indicates a type of the printing tape; the detection unit 520 that detects the type of the printing tape that is a target of printing; the extraction unit 530 that extracts, out of the storage unit, the text file associated with the information that indicates the type of the printing tape detected by the detection unit 520; and the display control unit 540 that causes a display unit to display the extracted text file as a selection candidate for the text file that is to be printed on the printing tape.

A method for controlling the tape printing apparatus 1 that performs printing on a printing tape includes: causing a storage unit to store a text file that contains a text in association with information that indicates a type of the printing tape; detecting the type of the printing tape that is a target of printing; extracting, out of the storage unit, the text file associated with the information that indicates the detected type of the printing tape; and causing a display unit to display the extracted text file as a selection candidate for the text file that is to be printed on the printing tape.

According to this configuration, the tape printing apparatus 1 detects the type of the printing tape, and causes the display unit to display the text file associated with the information that indicates the detected type of the printing tape as the selection candidate for the text file that is to be printed on the printing tape. This makes it possible to prevent the user from selecting a text file that cannot be printed on the printing tape by mistake.

In the tape printing apparatus 1 described above, the display control unit 540 may receive a scroll operation on the display unit on which the selection candidate for the text file is displayed, and may scroll the selection candidate for the text file.

According to this configuration, the tape printing apparatus 1 receives a scroll operation on the display unit on which the selection candidate for the text file is displayed, and scrolls the selection candidate for the text file. This enables the user to select a text file quickly.

The tape printing apparatus 1 described above may further include: the editing control unit 550; wherein the display control unit 540 may cause the display unit to display the text contained in the text file as the selection candidate for the text file, and the editing control unit 550 may accept editing of the text in a state in which the selection candidate for the text file is displayed on the display unit, and may update the text file whose text is edited.

According to this configuration, the tape printing apparatus 1 accepts editing of the text in a state in which the selection candidate for the text file is displayed on the display unit. This saves the user the trouble of switching from a screen on which the selection candidate for the text file is displayed to an edit screen that is screen for text editing when the editing is performed.

In the tape printing apparatus 1 described above, the extraction unit 530 may extract the text file such that the text file extracted when a first type is detected as the type of the printing tape by the detection unit 520 is different from the text file extracted when a second type is detected as the type of the printing tape by the detection unit 520, the first type is a type in which a printable area where printing is able to be performed is pre-determined in a printing layer of the printing tape, and the second type is a type in which the printable area is not pre-determined in the printing layer of the printing tape.

According to this configuration, the tape printing apparatus 1 is able to perform candidate display such that the selection candidate for the text file displayed when the first type, that is, a type in which a printable area where printing is able to be performed is pre-determined, is detected as the type of the printing tape is different from the selection candidate for the text file displayed when the second type, that is, a type in which the printable area is not pre-determined, is detected as the type of the printing tape.

In the tape printing apparatus 1 described above, the extraction unit 530 may extract the text file such that the text file extracted when a type of the printing tape in which a first printable area is pre-determined as the printable area in the printing layer of the first type of the printing tape is detected by the detection unit 520 is different from the text file extracted when a type of the printing tape in which a second printable area different from the first printable area is pre-determined as the printable area in the printing layer of the first type of the printing tape is detected by the detection unit 520.

According to this configuration, the tape printing apparatus 1 is able to perform candidate display such that the selection candidate for the text file displayed when a type of the printing tape in which the first printable area is pre-determined is detected is different from the selection candidate for the text file displayed when a type of the printing tape in which the second printable area is pre-determined is detected.

An information processing apparatus configured to communicate with the tape printing apparatus 1 that performs printing on a printing tape includes: the storage control unit 510 that causes a storage unit to store a text file that contains a text in association with information that indicates a type of the printing tape; a receiving unit that receives information that indicates the type of the printing tape that is a target of printing from the tape printing apparatus 1; the extraction unit 530 that extracts, out of the storage unit, the text file associated with the received information that indicates the type of the printing tape; and the display control unit 540 that causes a display unit to display the extracted text file as a selection candidate for the text file that is to be printed on the printing tape.

A non-transitory storage medium stores a program for causing an information processing apparatus configured to communicate with the tape printing apparatus 1 that performs printing on a printing tape to execute operations comprising: causing a storage unit to store a text file that contains a text in association with information that indicates a type of the printing tape; receiving information that indicates the type of the printing tape that is a target of printing from the tape printing apparatus 1; extracting, out of the storage unit, the text file associated with the received information that indicates the type of the printing tape; and causing a display unit to display the extracted text file as a selection candidate for the text file that is to be printed on the printing tape.

According to this configuration, the information processing apparatus receives information that indicates the type of the printing tape from the tape printing apparatus 1, and causes the display unit to display the text file associated with the received information as the selection candidate for the text file that is to be printed on the printing tape. This makes it possible to prevent the user from selecting a text file that cannot be printed on the printing tape, on which printing is to be performed by the tape printing apparatus 1, by mistake.

What is claimed is:

1. A tape printing apparatus, comprising:

a printing unit that performs printing on a printing tape;

a storage control unit that causes a storage unit to store a text file that contains a text in association with information that indicates a type of the printing tape;

a detection unit that detects the type of the printing tape that is a target of printing;

an extraction unit that extracts, out of the storage unit, the text file associated with the information that indicates the type of the printing tape detected by the detection unit; and a display control unit that causes a display unit to display the extracted text file as a selection candidate for the text file that is to be printed on the printing tape, wherein the extraction unit extracts the text file such that the text file extracted when a first type is detected as the type of the printing tape by the detection unit is different from the text file extracted when a second type is detected as the type of the printing tape by the detection unit, the first type is a type in which a printable area where printing is able to be performed is pre-determined in a printing layer of the printing tape, and the second type is a type in which the printable area is not pre-determined in the printing layer of the printing tape.

2. The tape printing apparatus according to claim 1, wherein the display control unit receives a scroll operation on the display unit on which the selection candidate for the text file is displayed, and scrolls the selection candidate for the text file.

3. The tape printing apparatus according to claim 1, further comprising:

an editing control unit; wherein the display control unit causes the display unit to display the text contained in the text file as the selection candidate for the text file, and the editing control unit accepts editing of the text in a state in which the selection candidate for the text file is displayed on the display unit, and updates the text file whose text is edited.

4. The tape printing apparatus according to claim 1, wherein the extraction unit extracts the text file such that the text file extracted when a type of the printing tape in which a first printable area is pre-determined as the printable area in the printing layer of the first type of the printing tape is detected by the detection unit is different from the text file extracted when a type of the printing tape in which a second printable area different from the first printable area is pre-determined as the printable area in the printing layer of the first type of the printing tape is detected by the detection unit.

5. An information processing apparatus configured to communicate with a tape printing apparatus that performs printing on a printing tape, the information processing apparatus comprising:

a storage control unit that causes a storage unit to store a text file that contains a text in association with information that indicates a type of the printing tape;

a receiving unit that receives information that indicates the type of the printing tape that is a target of printing from the tape printing apparatus;

an extraction unit that extracts, out of the storage unit, the text file associated with the received information that indicates the type of the printing tape; and a display control unit that causes a display unit to display the extracted text file as a selection candidate for the text file that is to be printed on the printing tape, wherein the extraction unit extracts the text file such that the text file extracted when a first type is received as the type of the printing tape by the receiving unit is different from the text file extracted when a second type is received as the type of the printing tape by the receiving unit, the first type is a type in which a printable area where printing is able to be performed is pre-determined in a printing layer of the printing tape, and the second type is a type in which the printable area is not pre-determined in the printing layer of the printing tape.

6. A method for controlling a tape printing apparatus that performs printing on a printing tape, comprising:

causing a storage unit to store a text file that contains a text in association with information that indicates a type of the printing tape;

detecting the type of the printing tape that is a target of printing;

extracting, out of the storage unit, the text file associated with the information that indicates the detected type of the printing tape; and causing a display unit to display the extracted text file as a selection candidate for the text file that is to be printed on the printing tape, wherein the extracting extracts the text file such that the text file extracted when a first type is detected as the type of the printing tape by the detecting is different from the text file extracted when a second type is detected as the type of the printing tape by the detecting, the first type is a type in which a printable area where printing is able to be performed is pre-determined in a printing layer of the printing tape, and the second type is a type in which the printable area is not pre-determined in the printing layer of the printing tape.

7. A non-transitory storage medium storing a program for causing an information processing apparatus configured to communicate with a tape printing apparatus that performs printing on a printing tape to execute operations comprising:

causing a storage unit to store a text file that contains a text in association with information that indicates a type of the printing tape;

receiving information that indicates the type of the printing tape that is a target of printing from the tape printing apparatus;

extracting, out of the storage unit, the text file associated with the received information that indicates the type of the printing tape; and causing a display unit to display the extracted text file as a selection candidate for the text file that is to be printed on the printing tape, wherein the extracting extracts the text file such that the text file extracted when a first type is received as the type of the printing tape by the receiving is different from the text file received when a second type is detected as the type of the printing tape by the receiving, the first type is a type in which a printable area where printing is able to be performed is pre-determined in a printing layer of the printing tape, and the second type is a type in which the printable area is not pre-determined in the printing layer of the printing tape.

* * * * *